US008129700B2

(12) United States Patent
Ueno et al.

(10) Patent No.: US 8,129,700 B2
(45) Date of Patent: Mar. 6, 2012

(54) OPTICAL ELEMENT CONTAMINATION PREVENTING METHOD AND OPTICAL ELEMENT CONTAMINATION PREVENTING DEVICE OF EXTREME ULTRAVIOLET LIGHT SOURCE

(75) Inventors: Yoshifumi Ueno, Tokyo (JP); Masato Moriya, Tokyo (JP); Masaki Nakano, Tokyo (JP); Hiroshi Komori, Tokyo (JP)

(73) Assignee: Komatsu Ltd., Tokyo (JP)

( * ) Notice: Subject to any disclaimer, the term of this patent is extended or adjusted under 35 U.S.C. 154(b) by 70 days.

(21) Appl. No.: 12/150,077

(22) Filed: Apr. 24, 2008

(65) Prior Publication Data

US 2008/0267816 A1 Oct. 30, 2008

(30) Foreign Application Priority Data

Apr. 27, 2007 (JP) ..... 2007-118965

(51) Int. Cl.
*H05G 2/00* (2006.01)

(52) U.S. Cl. ..... 250/504 R; 250/493.1

(58) Field of Classification Search ..... 250/493.1, 250/504 R

See application file for complete search history.

(56) References Cited

U.S. PATENT DOCUMENTS

| | | | | |
|---|---|---|---|---|
| 6,987,279 | B2 * | 1/2006 | Hoshino et al. | 250/504 R |
| 7,067,832 | B2 * | 6/2006 | Mizoguchi et al. | 250/504 R |
| 7,078,717 | B2 * | 7/2006 | Mizoguchi | 250/504 R |
| 7,217,941 | B2 * | 5/2007 | Rettig et al. | 250/504 R |
| 7,271,401 | B2 * | 9/2007 | Imai et al. | 250/504 R |
| 7,589,337 | B2 * | 9/2009 | Bykanov et al. | 250/504 R |
| 7,671,349 | B2 * | 3/2010 | Bykanov et al. | 250/504 R |
| 2005/0205803 | A1 * | 9/2005 | Mizoguchi | 250/492.2 |
| 2006/0097203 | A1 * | 5/2006 | Bykanov et al. | 250/504 R |
| 2006/0186356 | A1 * | 8/2006 | Imai et al. | 250/504 R |
| 2006/0219957 | A1 * | 10/2006 | Ershov et al. | 250/504 R |
| 2007/0001130 | A1 * | 1/2007 | Bykanov et al. | 250/493.1 |
| 2007/0228298 | A1 * | 10/2007 | Komori et al. | 250/493.1 |
| 2008/0087847 | A1 * | 4/2008 | Bykanov et al. | 250/504 R |
| 2008/0149862 | A1 * | 6/2008 | Hansson et al. | 250/504 R |

(Continued)

FOREIGN PATENT DOCUMENTS

JP 2006-80255 3/2006

(Continued)

OTHER PUBLICATIONS

F.Bijkerk et al.: Performance optimization of a high-repetition-rate KrF laser plasma x-ray source for microlithography, J. X-Ray Sci. Technol., 3,133-151 (1992).

(Continued)

*Primary Examiner* — Michael Maskell
(74) *Attorney, Agent, or Firm* — Husch Blackwell LLP

(57) ABSTRACT

Solid tin (Sn) is used as a target, a $CO_2$ laser is used as an excitation source for the target, and after the size of debris emitted from plasma is decreased to a nanometer or smaller size by exciting the solid tin by a laser beam outputted from the $CO_2$ laser, the emitted debris of a nanometer or smaller size is acted upon so as not to reach the optical element. In accordance with the present invention, in the EUV light source apparatus, the debris emitted together with EUV light from plasma generated by exciting a target within a chamber by a laser beam is prevented from adhering to an optical element provided within the chamber and forming a metal film. As a result, the service life of the optical element can be extended.

13 Claims, 21 Drawing Sheets

U.S. PATENT DOCUMENTS

| | | | | |
|---|---|---|---|---|
| 2008/0179548 | A1* | 7/2008 | Bykanov et al. | 250/504 R |
| 2008/0179549 | A1* | 7/2008 | Bykanov et al. | 250/504 R |
| 2008/0237498 | A1* | 10/2008 | MacFarlane | 250/493.1 |
| 2009/0095925 | A1* | 4/2009 | Ershov et al. | 250/504 R |
| 2009/0267005 | A1* | 10/2009 | Bykanov et al. | 250/504 R |

FOREIGN PATENT DOCUMENTS

WO WO2004/092693 10/2004

OTHER PUBLICATIONS

G.D. Kubiak et al.: Diffraction-limited soft x-ray projection lithography with a laser plasma source, J.Van. Sci. Technol. B9, 3184-3188 (1991).

G.D. Kubiak et al.: Laser plasma source for SXPL: production and mitigation of debris, OSA Proceedings on Soft X-Ray Projection Lithography, A Hawryluk and R. Stulen, eds., vol. 18 of OSA Proceedings Series, Optical Society of America, Washington D.C. (1993).

H.A. Bender et al.: Avenger velocity distribution measurements of target debris fom a laser-produced plasma, in Applications of Laser Plasma Radiation, M.C. Richardson, ed.,Proc. Photo-Opt. In-strum. 2015,113-117, (1994).

Proc. of SPIE vol. 5751, p. 248-259.

Refusing Reason Notice No. 2007-118965 for related Japanese Application.

Yoshifumi Ueno et al., Characterization of Various Sn Targets with Respect to Debris and Fast Ion Generation, Proceedings of SPIE, Mar. 2007, vol. 6517, pp. 65173B.

Translation of Refusing Reason Notice No. 2007-118965 for related Japanese Patent Application.

* cited by examiner

| SPECIMEN: sample | |
|---|---|
| TAKEN WITH H-9000NAR | MAGNIFICATION: 2,000,000 |
| MST-06-112573 | AT 300 kV |

| SPECIMEN: No. 10 Sn 3.8 nm COATING (NO SURFACE TREATMENT, REFERENCE SAMPLE) | |
|---|---|
| TAKEN WITH H-9000NAR | MAGNIFICATION: 2,000,000 |
| MST-06-112140 IDNo. 3562c | AT 300 kV |

| PARTICLE DIAMETER (μm) | UPPER LIMIT OF ELECTRIC CHARGE AMOUNT Q (pC) | MASS M (kg) | RATIO Q/M (pC/kg) | DEFLECTION VELOCITY (WITHIN ELECTRODE) vx (m/s) | DEFLECTION DISTANCE (WITHIN ELECTRODE) x (mm) | DEFLECTION DISTANCE (MEASUREMENT POINT) X (mm) |
|---|---|---|---|---|---|---|
| 1 | 0.02 | 3.82E-15 | 5.49E+12 | 73.26 | 48.84 | 293.04 |
| 10 | 0.66 | 3.82E-12 | 1.74E+11 | 2.32 | 1.54 | 9.27 |
| 100 | 21.00 | 3.82E-09 | 5.49E+09 | 0.07 | 0.05 | 0.29 |

FIG.10

OPTICAL ELEMENT CONTAMINATION PREVENTING METHOD AND OPTICAL ELEMENT CONTAMINATION PREVENTING DEVICE OF EXTREME ULTRAVIOLET LIGHT SOURCE

BACKGROUND OF THE INVENTION

1. Field of the Invention

The present invention relates to an optical element contamination preventing method and an optical element contamination preventing device that prevent optical elements from contamination with a scattered material generated together with extreme ultraviolet light (EUV) in an EUV light source apparatus used as a light source for exposure devices.

2. Description of the Related Art

The transition to microstructures in semiconductor processes has recently been followed by a rapid transition to microstructures in photolithography, and next-generation processes have created a demand for microprocessing at a level from 100 nm to 70 nm and further for microprocessing at a level of 50 nm or less. Accordingly, for example, the development of exposure devices that combine a EUV light source with a wavelength of about 13 nm and a catadioptric system is expected, such exposure devices meeting the requirement for microprocessing at a level of 50 nm or less.

EUV light sources of three types are known: an LPP (laser produced plasma) light source (referred to hereinbelow as an LPP-type EUV light source apparatus) that uses plasma generated by irradiating a target with a laser beam, a DPP (discharge produced plasma) light source that uses plasma generated by an electric discharge, and an SR (synchrotron radiation) light source that uses synchrotron radiation. Among them, an LPP light source is thought to be effective as a light source for EUV lithography that requires a power of several tens of watts or higher because this light source has the following advantages over the other light sources: a very high luminance close to black body radiation can be obtained because the plasma density can be significantly increased; light emission only in the necessary wavelength band can be obtained by selecting a target substance; no structural elements such as electrodes are present around the light source because a point light source having an almost isotropic angular distribution is used; and a very large collection angle of $2\pi$steradian can be ensured.

The principle of EUV light generation in the LPP system will be explained below. Where a target substance supplied into a vacuum chamber is irradiated with a laser beam, the target substance is excited and converted into plasma. A variety of wavelength components including the EUV light are emitted from the plasma. An EUV collector mirror that selectively reflects the desired wavelength component (for example, a component having a wavelength of 13.5 nm) is disposed within the vacuum chamber, the EUV light is reflected and collected by the EUV collector mirror, and the collected light is outputted to an exposure device. Tin (Sn), lithium (Li), xenon (Xe), and the like can be used as the target substance, but tin (Sn) is preferred among them because it allows a high EUV conversion efficiency to be obtained. A multilayer film (Mo/Si multilayer film) in which molybdenum (Mo) thin films and silicon (Si) thin films are alternately laminated is formed on the reflecting surface of the EUV collector mirror.

In such LPP-type EUV light source apparatus, problems are associated with the effect produced by neutral particles and ions emitted from the plasma and target, in particular, when a solid target is used. Because the EUV collector mirror is disposed close to plasma, neutral particles emitted from the plasma and target adhere to the reflective surface of the EUV collector mirror and decrease the reflectance of the mirror. On the other hand, ions emitted from the plasma erode (in the present application, this process will be referred to as "sputtering") the multilayer film formed on the reflective surface of the EUV collector mirror. In the description of the present application, the adverse effect produced by such neutral particles and ions on optical elements is called "contamination". The scattered material from plasma containing the neutral particles or ions and residual fragments of the target substance are called "debris".

In an EUV collector mirror, a high surface flatness, for example, of about 0.2 nm (rms) is required to maintain a high reflectance, and meeting such a requirement is very expensive. Where the EUV collector mirrors are frequently replaced to resolve this problems, not only the maintenance time extends, but also the operation cost rises. Accordingly, from the standpoint of reducing the operation cost of exposure device and shortening the maintenance time, it is desirable that the service life of EUV collector mirror be extended. The mirror life in an EUV light source apparatus for exposure is defined, for example, as a period in which the reflectance decreases by 10%, and a service life of at least 1 year is required.

As described hereinabove, debris adheres to the surface of the EUV collector mirror and form a metal film. Because the metal film absorbs EUV light, the reflectance of the EUV collector mirror decreases. Assuming that light transmittance of the metal film is about 95%, the reflectance of the EUV collector mirror becomes about 90%. For the service life of EUV collector mirror to be equal to or more than 1 year, the decrease in the reflectance of the EUV collector mirror with respect to the EUV light having a wavelength of 13.5 nm has to be within 10%. Therefore, the allowed values of the adhered quantity (thickness) of the metal film on the reflective surface of the EUV collector mirror are extremely small and constitute about 5 nm for lithium and about 0.75 nm for tin.

Because metal films of such thickness are formed within a comparatively short period, it is important to prevent the adhesion of metal film to the EUV collector mirror. A variety of methods disclosed in the patent documents and the non-patent documents mentioned below have been suggested to prevent the adhesion of metal film.

The patent document 1 (US Patent Application Publication No. 2005/0279946 (Specification, page 1)) discloses a technology for generating a magnetic field or an electric field within a vacuum chamber and guiding the debris. Where the desired magnetic field or electric field is generated within a vacuum chamber, ions that are scattered from plasma toward optical elements are deflected and guided to locations other than the optical elements.

However, the technology described in the patent document 1 is effective only with respect to ions contained in the debris. The debris, however, contains not only ions, but also neutral particles. The neutral particles, which carry no electric charge, are not deflected by the magnetic field or electric field and reach the optical elements.

The patent document 2 (U.S. Pat. No. 6,987,279 (Specification, page 1)) discloses a method by which neutral particles emitted from plasma are ionized by an appropriate means such as ultraviolet radiation and then deflected by the action of a magnetic field. The patent document 3 (Japanese Patent Application Laid-open No. 2006-80255) discloses a method similar to that of the patent document 2 by which neutral particles emitted from plasma are ionized and deflected by the action of a magnetic field. In the patent document 3, electron cyclotron resonance (ECR) is induced by irradiating electrons with microwaves, and neutral particles are ionized by causing the plasma to collide with neutral particles. With the inventions described in the patent document 2 and the patent document 3, it is possible to deflect not only ions emitted from plasma, but also neutral particles.

However, neutral particles with a large diameter are difficult to ionize. Therefore, large neutral particles are not deflected by a magnetic field and reach optical elements.

The non-patent document 1 (F. Bijkerk, E. Louis, M. van der Wiel, G. Turcu, G. Tallents, and D. Batani, "Performance Optimization of a High-Repetition-Rate KrF Laser Plasma X-Ray Source for Microlithography", J. X-Ray Sci. Technol., 3, 133-135 (1992)) and the non-patent document 2 (G. D. Kubiak, D. A. Tichenor, M. E. Malinowski, R. H. Stulen, S. J. Haney, K. W. Berger, L. A. Brown, J. E. Bjorkholm, R. Freeman, W. M. Mansfield, D. M. Tennant, O. R. Wood II, J. Bokor, T. E. Jewell, D. L. White, D. L. Windt, and W. K. Waskiewics, "Diffraction-limited soft x-ray projection lithography with a laser plasma source", J. Van. Sci. Technol. B9, 3184-3188 (1991)) disclose a method for supplying a background gas with a predetermined pressure inside a vacuum chamber. Where a He background gas atmosphere with a pressure of about 0.2 Torr is obtained within a vacuum chamber, the kinetic energy of debris with a diameter of 0.3 μm or less, from among the debris scattered from plasma toward optical elements, can be reduced. This phenomenon can be explained as follows. The debris with a small diameter has a small mass and, therefore, a small kinetic energy ($\frac{1}{2}MV^2$) and such particles lose their kinetic energy before reaching the optical elements due to collisions with particles of background gas.

However, debris with a diameter of 0.5 μm or more, such as described in the non-patent document 3 (G. D. Kubiak, K. W. Berger, S. J. Haney, P. D. Rockett, and J. A. Hunter, "Laser Plasma Sources for SXPL: Production and Mitigation of Debris" in Soft X-Ray Projection Lithography, A. Hawryluk and R. Stulen, eds., Vol, 18 of OSA Proceedings Series Optical Society of America, Washington, D.C., 1993) and the non-patent document 4 (H. A. Bender, A. M. Eligon, D. O'Connell, and W. T. Silfvast, "Avenger velocity distribution measurements of target debris from a laser-produced plasma", in Applications of Laser Plasma Radiation, M. C. Richardson, ed., Proc. Photo-Opt. In-strum. 2015, 113-117 (1994)), has a large mass and, therefore, a high kinetic energy. For this reason such debris does not lose their kinetic energy on collisions with background gas particles and, therefore, reaches optical elements.

The patent document 4 (International Patent Application Publication No. 2004/092693 Pamphlet (pages 1 and 11, FIGS. 2A and 2B)) describes a method according to which a debris shield is provided between a plasma generation region and an EUV collector mirror to protect the EUV collector mirror from the scattered debris.

However, with such method, the debris shield is exposed instead of the EUV collector mirror to plasma. As a result, the debris shield is sputtered by high-velocity ions, new debris is generated, and this debris can adhere to the EUV collector mirror. In other words, the debris shield itself becomes a source of debris. Further, frequent cleaning is necessary to remove the debris that has adhered to the debris shield and problems are associated with maintenance.

The non-patent document 5 (Proc. of SPIE, Vol. 5751, p. 248-259) discloses a method by which when a target is from lithium, a mirror is maintained at a high temperature of about 400° C. and the adhesion of debris is prevented by a diffusion effect (evaporation) when the target is from lithium. However, because tin has a large particle diameter and low vapor pressure, tin cannot be caused to diffuse in vacuum.

The debris shield disclosed in the patent document 4 requires frequent maintenance and, therefore, rises the maintenance cost. Further, because the exposure operation has to be stopped each time maintenance is performed, the exposure efficiency is decreased.

The method disclosed in the non-patent document 5 is effective when lithium having a high vapor pressure is used for the target, but is ineffective when the target is from tin having a low vapor pressure.

In general, it can be concluded that the methods disclosed in the patent documents 1-3, and the non-patent documents 1-2 are more effective in preventing the adhesion of debris. Although the drawback of these methods is that debris with a large diameter cannot be prevented from adhering to optical elements, at present the adhesion of such debris has to be tolerated.

The present invention has been created in view of the foregoing and it is an object thereof to prevent the debris emitted together with EUV light from plasma generated by excitation of a target in a chamber by a laser beam from adhering to optical elements provided within the chamber and forming a metal film and to extend the service life of the optical elements.

SUMMARY OF THE INVENTION

The first invention provides an optical element contamination preventing method for an extreme ultraviolet light source apparatus by which a scattered material emitted together with extreme ultraviolet light from plasma generated by excitation of a target within a chamber by a laser beam is prevented from contaminating an optical element provided within the chamber, the method comprising: decreasing the size of the scattered material emitted from the plasma to a nanometer or smaller size by using solid tin as the target and using a $CO_2$ laser as an excitation source for the solid tin; and acting upon the scattered material of a nanometer or smaller size to prevent the scattered material from reaching the optical element.

The second invention provides an optical element contamination preventing device for an extreme ultraviolet light source apparatus in which a scattered material emitted together with extreme ultraviolet light from plasma generated by excitation of a target within a chamber by a laser beam is prevented from contaminating an optical element provided within the chamber, wherein solid tin is used as the target, a $CO_2$ laser is used as an excitation source for the solid tin, and the device comprises contamination preventing means for acting upon the scattered material of a nanometer or smaller size that is emitted from plasma generated following the excitation of the solid tin by the $CO_2$ laser to prevent the scattered material from reaching the optical element.

The third invention provides the optical element contamination preventing device according to the second invention, wherein the contamination preventing means comprises: background gas supply means for supplying into the chamber background gas that prevents the nanosize scattered material from reaching the optical element.

The fourth invention provides the optical element contamination preventing device according to the second invention, wherein the contamination preventing means comprises: gas flow formation means for generating inside the chamber a gas flow that prevents the nanosize scattered material from reaching the optical element.

The fifth invention provides the optical element contamination preventing device according to the second invention, wherein the contamination preventing means comprises:

charging means for electrically charging the scattered material; and magnetic field formation means for generating inside the chamber a magnetic field that prevents the charged nanosize scattered material from reaching the optical element.

The sixth invention provides the optical element contamination preventing device according to the second invention, wherein the contamination preventing means comprises: charging means for electrically charging the scattered material; and electric field formation means for generating inside the chamber an electric field that prevents the charged nanosize scattered material from reaching the optical element.

The seventh invention provides the optical element contamination preventing device according to the second invention, wherein the contamination preventing means comprises heating means for evaporating (causing diffusion based on thermal motion) the nanosize scattered material.

The present invention has been created with the object of preventing the generation of scattered material, that is, debris with a large diameter, without controlling the movement of debris within the chamber in an extreme ultraviolet light source apparatus, in other words, an EUV light source apparatus. Thus, in accordance with the present invention, in an EUV light source apparatus, solid tin (Sn) is used as the target, a $CO_2$ laser is used as an excitation source for the solid tin, the size of debris emitted from plasma is decreased to a nanometer or smaller size by exciting the solid tin by a laser beam outputted from the $CO_2$ laser, and then the emitted nanosize debris is acted upon so as not to reach the optical element.

The inventors have discovered that where solid tin is excited by a $CO_2$ laser, most of the debris emitted from plasma is in the form of sub-nanosize to nanosize particles (molecular and atomic level). This is a heretofore unknown effect. The movement of microsize debris is difficult to control, but the movement of sub-nanosize to nanosize debris is comparatively easy to control.

For example, a background gas is supplied into the chamber to cause collisions of gas particles and debris. Alternatively, a gas flow is generated within the chamber to blow off the debris. Another option is to charge the debris electrically, generate a magnetic field or an electric field within the chamber, and act with the magnetic field of electric field upon the charged debris. Yet another possibility is to evaporate the debris by heating.

In accordance with the present invention, the size of debris emitted from plasma is reduced to a nanometer size by exciting a target of solid tin by a $CO_2$ laser. The movement of nanosize debris can be easily controlled with a comparatively small force or energy. Accordingly, nanosize debris can be almost completely prevented from reaching an EUV collector mirror by acting upon the nanosize debris with a force or energy that prevents the debris from reaching an optical element. As a result, formation of a metal film on the EUV collector mirror is prevented. Therefore, the service life of the optical element can be extended.

BRIEF DESCRIPTION OF THE DRAWINGS

FIG. 10 illustrates the results obtained in investigating the variation in the degree of deflection (deflection distance) for each particle diameter;

DETAILED DESCRIPTION OF THE INVENTION

The embodiments of the present invention will be described below with reference to the appended drawings.

A basic configuration of the EUV light source apparatus in accordance with the present invention will be described with reference to FIG. 1 and FIG. 2 prior to explaining the embodiments of the present invention. All the below-described embodiments will be assumed to have a configuration that will be explained using FIG. 1 and FIG. 2.

Figure 1:
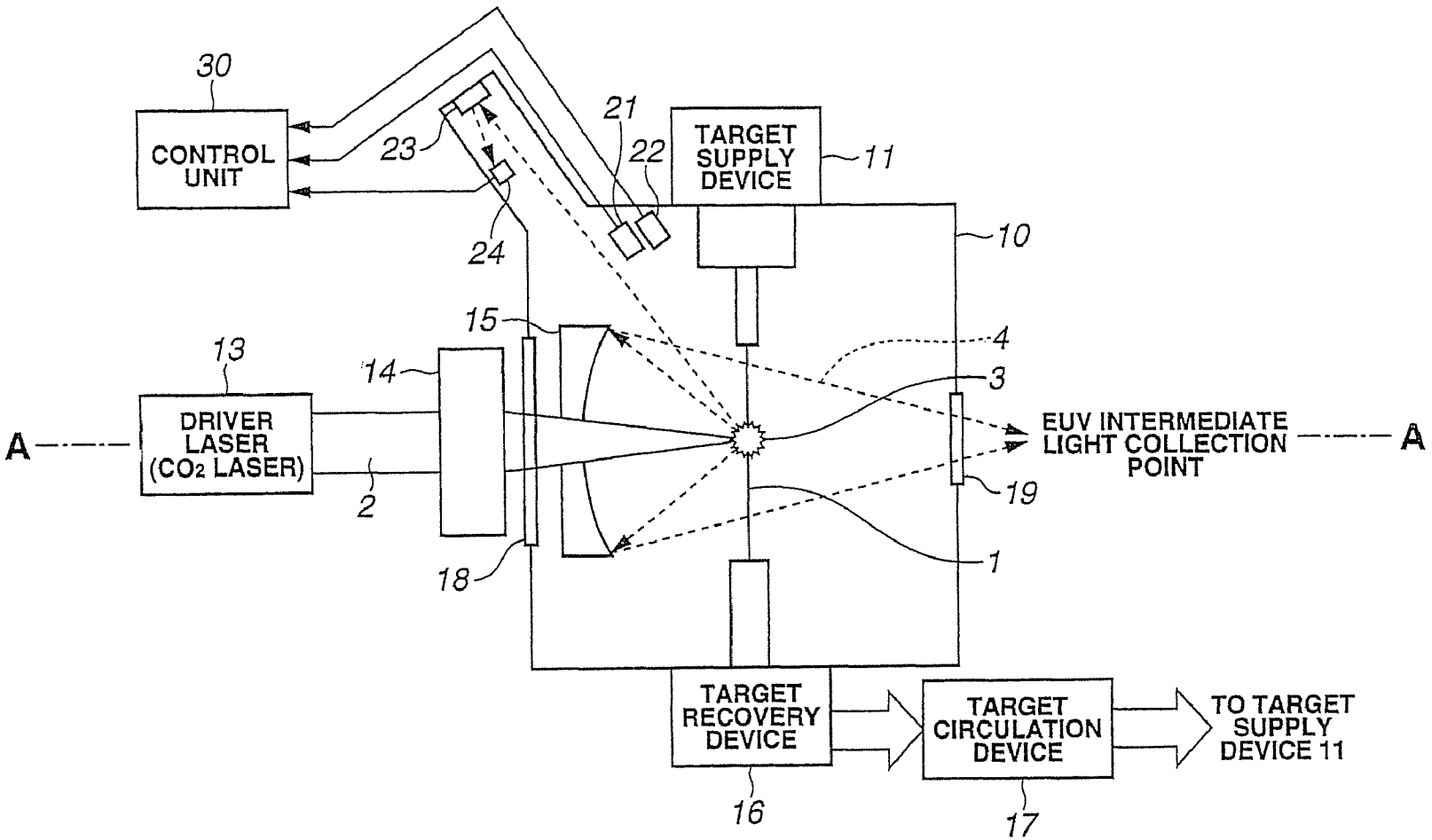
FIG. 1 is a side view illustrating the basic configuration of the EUV light source apparatus in accordance with the present invention.

FIG. 1 is a side view illustrating the basic configuration of the EUV light source apparatus in accordance with the present invention. FIG. 2 is an A-A cross sectional view of the configuration shown in FIG. 1. The EUV light source apparatus in accordance with the present invention employs a laser produced plasma (LPP) system in which EUV light is generated by using a laser beam for target irradiation and excitation.

Figure 2:
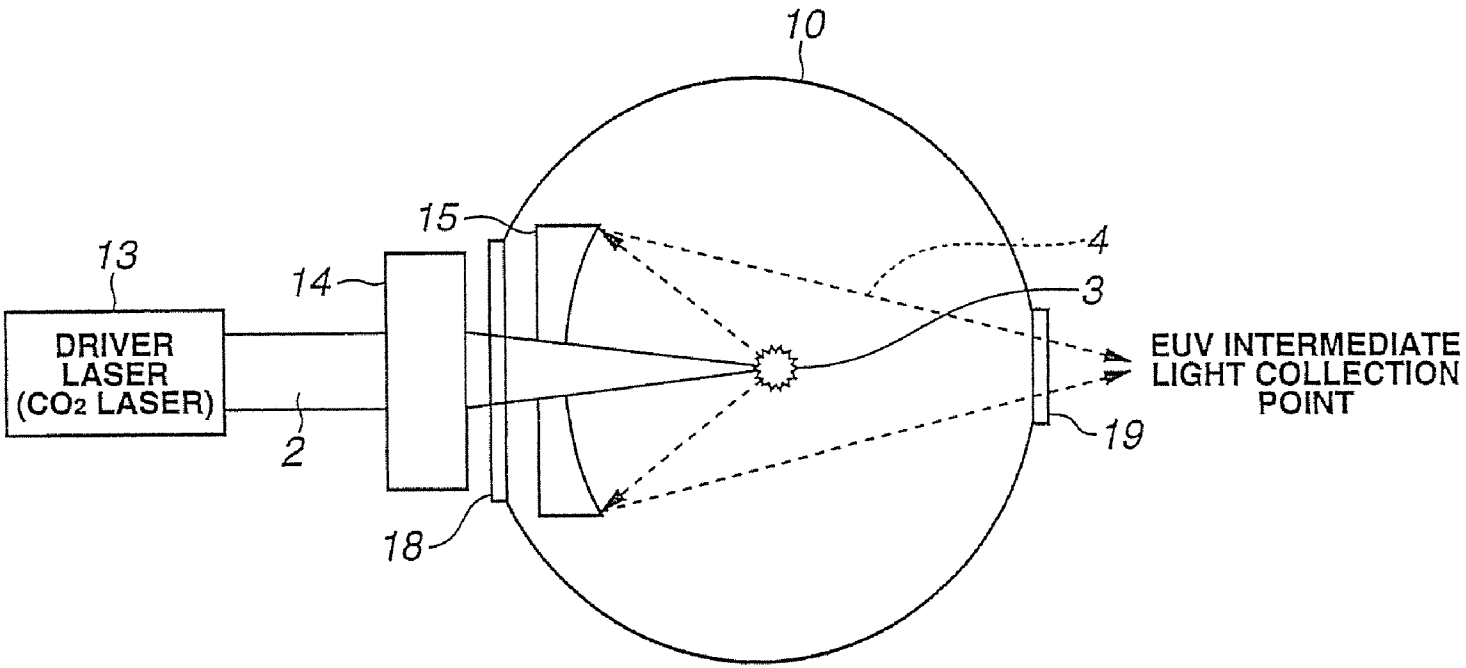
FIG. 2 is an A-A cross sectional view of the configuration shown in FIG. 1.

As shown in FIG. 1 and FIG. 2, the EUV light source apparatus comprises a vacuum chamber 10 where the EUV light is produced, a target supply device 11 that supplies a target 1, a driver laser 13 that generates an excitation laser beam 2 for irradiating the target 1, a laser collecting optical system 14 that collects the excitation laser beam 2 generated by the driver laser 13, an EUV collector mirror 15 that collects an EUV light 4 emitted from a plasma 3 generated by irradiating the target 1 with the excitation laser beam 2, a target recovery device 16 that recovers the target 1, a target circulating device 17 that circulates the target 1, and a control unit 30 that controls the entire EUV light source apparatus.

An inlet window 18 for introducing the excitation laser beam 2, and an outlet window 19 that guides the EUV light 4 reflected by the EUV collector mirror 15 toward an exposure device are provided in the vacuum chamber 10. A vacuum or pressure reduced state identical to that inside the vacuum chamber 10 is also maintained inside the exposure device. The target supply device 11 includes a position adjusting mechanism for adjusting the position of the target 1 that is irradiated with the excitation laser beam 2 and supplies the target 1 to the predetermined position within the vacuum chamber 10, while adjusting the position of the target 1.

The driver laser 13 is a laser beam source that can generate pulses at a high repetition frequency (for example, a pulse width is about several nanoseconds to several tens of nanoseconds and a frequency is about 1 kHz to 100 kHz). The laser collecting optical system 14 is composed of at least one lens and/or at least one mirror. The laser beam 2 emitted from the driver laser 13 falls onto the laser collecting optical system 14 and is then collected in the predetermined position within the vacuum chamber 10 and irradiated on the target 1. The target 1 irradiated with the laser beam 2 is partially excited and converted into plasma, and a variety of wavelength components are emitted from the plasma.

The EUV collector mirror 15 is a collecting optical system that collects by selective reflection a predetermined wavelength component (for example, EUV light with a wavelength close to 13.5 nm) from among a variety of wavelength components emitted from the plasma 3. The EUV collector mirror 15 has a concave reflective surface, and for example a multilayer film of molybdenum (Mo) and silicon (Si) for selectively reflecting the EUV light with a wavelength close to 13.5 nm is formed on the reflective surface. In FIG. 1, the EUV light is reflected by the EUV collector mirror 15 to the right, collected in the EUV intermediate focus point, and then outputted to the exposure device. The collecting optical system of EUV light is not limited to the EUV collector mirror 15 shown in FIG. 1 and may be composed using a plurality of optical elements, but it has to be a reflecting optical system for inhibiting the absorption of EUV light.

The target recovery device 16 includes a position adjusting mechanism for adjusting the position of the target 1 irradiated with the excitation laser beam 2, the position adjusting mechanism being disposed opposite the target supply device 11 on the other side of the light emission point. The target recovery device 16 recovers the target that has not been converted into plasma. The recovered target may by again returned by the target circulation device 17 to the target supply device 11 and reused.

Further, the EUV light source apparatus also comprises a mirror damage detector 21 for detecting the amount of neutral particles emitted from the plasma 3, an ion detector 22 for detecting the amount of ions emitted from the plasma 3, a multilayer film mirror 23 for detecting (not via the EUV collector mirror 15) the intensity of EUV light in the light emission point, and an EUV light detector 24.

The mirror damage detector 21 is configured, for example, of a QCM (quartz crystal microbalance). The QCM is a sensor that can measure the variation in thickness of a sample film (film for measurements), such as a gold (Au) film formed on a sensor surface, with an accuracy at an angstrom level or a lower level, based on the variations in the resonance frequency of a quartz oscillator. The amount of neutral particles (referred to hereinbelow as "deposition amount") that adhered to the reflective surface of the EUV collector mirror can be found based on the variation in thickness of the sample film detected by the mirror damage detector 21.

The ion detector 22 is composed, for example, of a Faraday cup. The amount of multilayer film (referred to hereinbelow as "sputtered amount") eroded from the reflective surface of the EUV collector mirror 15 can be found based on the amount of ions detected by the ion detector 22.

In the multilayer film mirror 23, for example, a multilayer film of molybdenum and silicon having a high reflectance with respect to a wavelength close to 13.5 nm is formed. The EUV light detector 24 is composed, for example, of a zirconium (Zr) filter and a photodiode. The zirconium filter cuts off the light with a wavelength of 20 nm or larger. The photodiode outputs a detection signal corresponding to the intensity or energy of the incident light.

In each embodiment of the present invention, solid tin (Sn) is used as the target 1. The solid tin can be used in a variety of forms such as a wire, a tape, a plate, a rod, or a sphere. Further, in order to remove heat, tin can my be coated on a core material. Examples of materials suitable as the core materials include materials with excellent thermal conductivity such as copper (thermal conductance of 390 W/mk), tungsten (thermal conductance 130 W/mk), and molybdenum (thermal conductance 145 W/mk), or materials with a high melting point such as tungsten (melting point 3382° C.), tantalum (melting point 2996° C.), and molybdenum (melting point 2622° C.). Alternatively, a material with a multilayer structure may be used. For example, a wire can be used in which a multilayer coating of copper and diamond is formed on a core wire of stainless steel that is used for cutting hard materials. A heat pipe with excellent thermal conductivity may be also used.

In the embodiments of the present invention, a $CO_2$ laser that can generate light with a comparatively long wavelength is used as the driver laser 13.

The solid tin and $CO_2$ laser are used because the combination of the solid tin and $CO_2$ laser makes it possible to obtain most of the debris emitted from the plasma in the form of sub-nanosize to nanosize particles (molecular or atomic level). This is the phenomenon that has heretofore been unknown and this phenomenon has been discovered by the following test conducted by the inventors.

Figure 3:
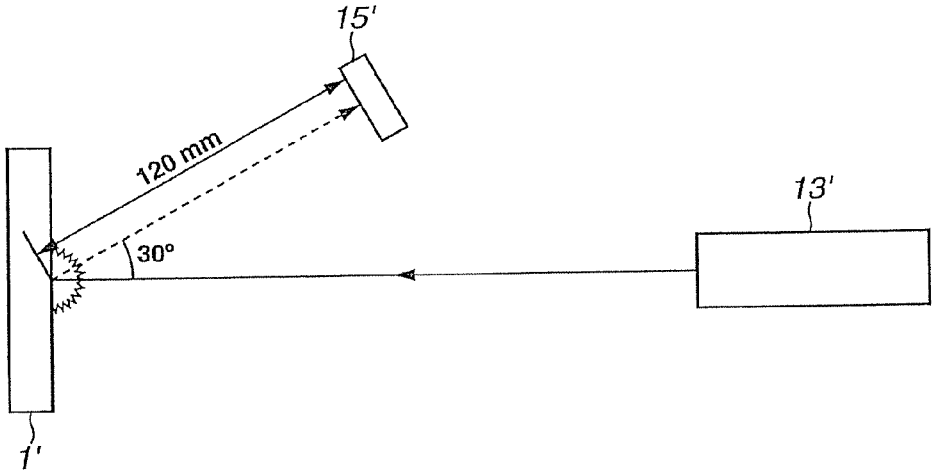
FIG. 3 shows a device configuration of the test performed by the inventors.

FIG. 3 shows the device configuration of the test performed by the inventors.

The device comprises plate-shaped tin 1', a TEA-$CO_2$ laser 13' disposed perpendicular to the surface of tin 1', and a Mo/Si sample mirror 15' for analysis that is arranged in a position inclined at an angle of about 30 degrees from the direction perpendicular to the surface of tin 1' at a distance of about 120 mm from the tin. The inventors observed debris that adhered to the Mo/Si sample mirror 15' by irradiating tin with 150,000 or more shots under conditions enabling a sufficient EUV emission; the energy of the TEA-$CO_2$ laser 13' was about 15 to 25 mJ, the pulse time half-width was 10 ns, and the converged spot size was about 100 μm.

Figure 4:
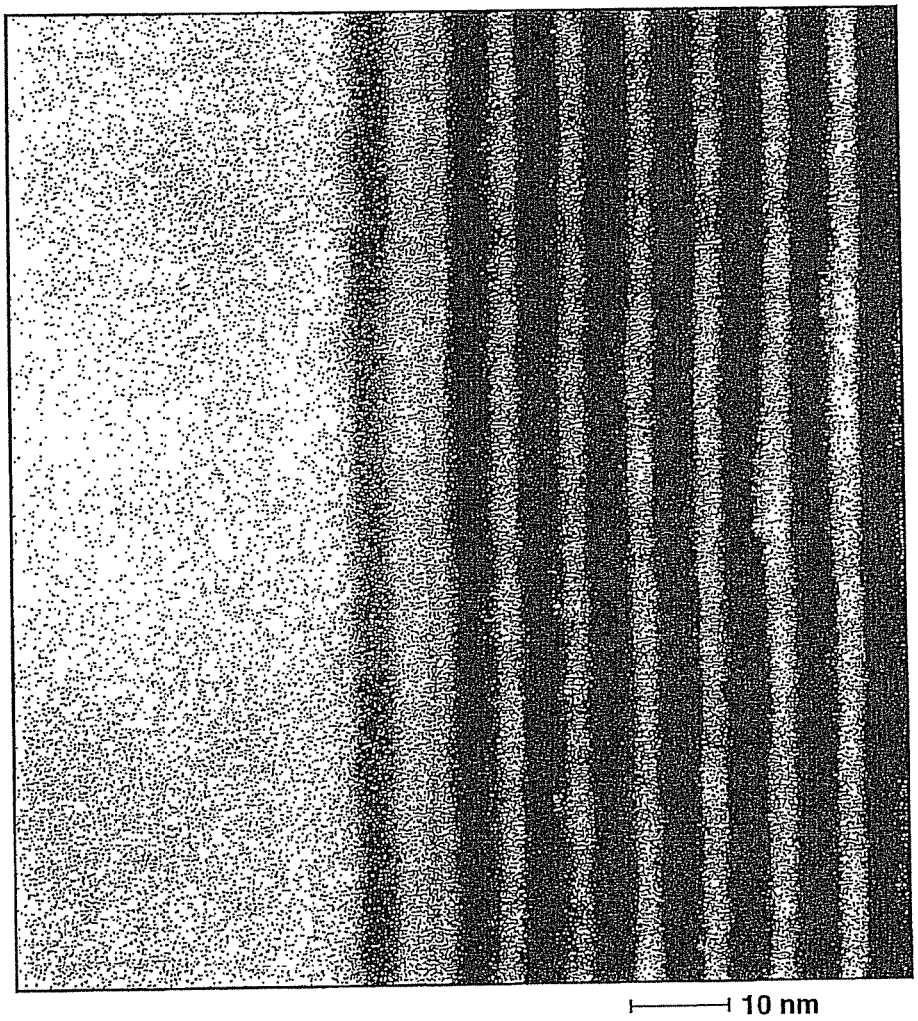
FIG. 4 is a cross-sectional photograph of a metal film obtained in the test performed by the inventors.
Figure 5:
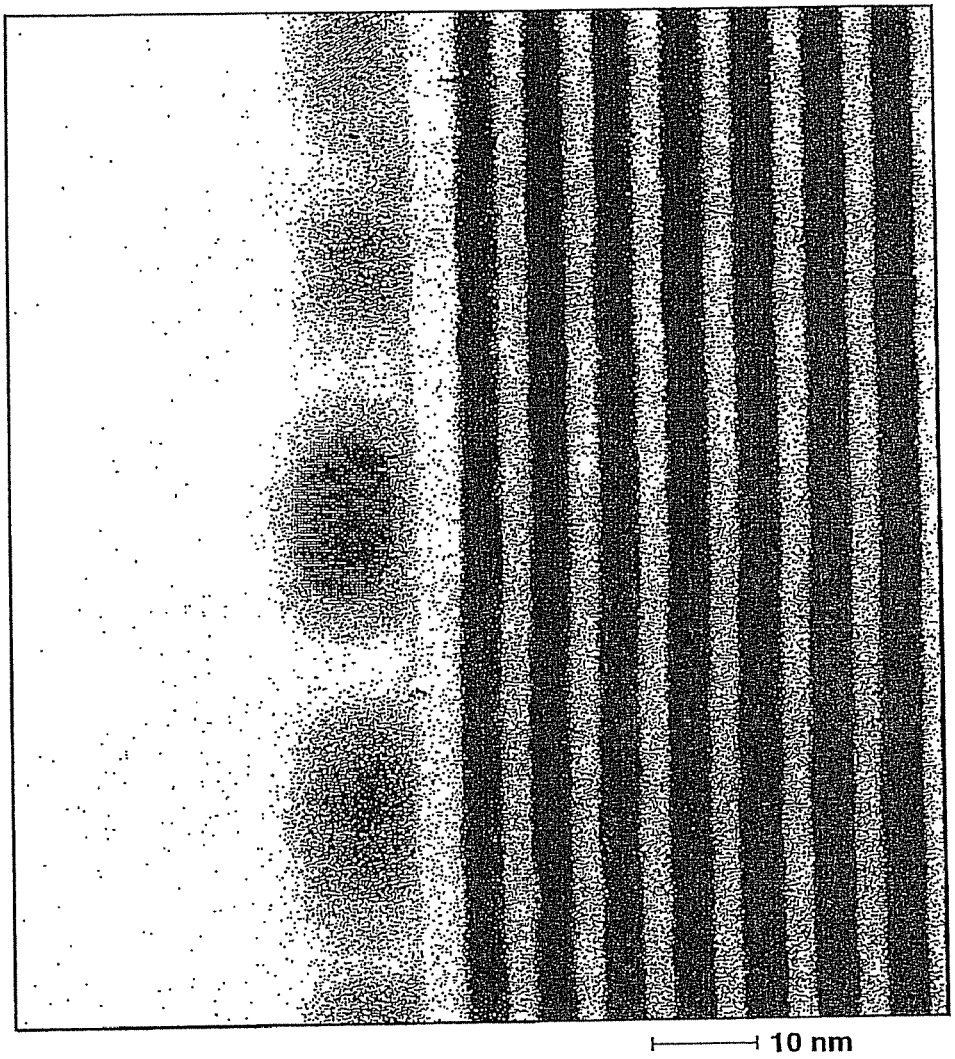
FIG. 5 is a cross-sectional photograph of a metal film obtained by vacuum vapor deposition.

FIG. 4 is a cross-sectional photograph of a metal film obtained in the test performed by the inventors. FIG. 5 is a cross-sectional photograph of a metal film obtained by vacuum vapor deposition, this figure representing a comparative example of the test.

FIG. 4 confirms that a metal film is formed on the surface of the Mo/Si sample mirror 15'. However, FIG. 4 cannot confirm that particles have adhered to the surface of the Mo/Si sample mirror 15'. On the other hand, when tin adheres to the sample surface as a result of vapor deposition, the adhesion of particles with a size of about 10 μm can be confirmed, as shown in FIG. 5. These results suggest that the metal film formed on the surface of the Mo/Si sample mirror 15' is constituted by sub-nanosize to nanosize particles that are smaller than microsize particles. Thus, it can be supposed that when solid tin is excited by a $CO_2$ laser, most of the debris emitted from plasma is in the form of sub-nanosize to nanosize particles.

The debris with a small particle diameter has a smaller mass and also a smaller kinetic energy than debris with a large particle diameter. Further, as described hereinabove, the debris with a small particle diameter is easier to provide with an electric charge than the debris with a large particle diameter. In other words, if the debris is imparted with an action of preventing it from reaching an optical element after it has been reduced to a nanosize by exciting solid tin by a $CO_2$ laser, the contamination of optical element can be effectively prevented. The action preventing the nanosize debris from reaching the optical element will be explained below based on specific embodiments.

Embodiment 1

Figure 6:
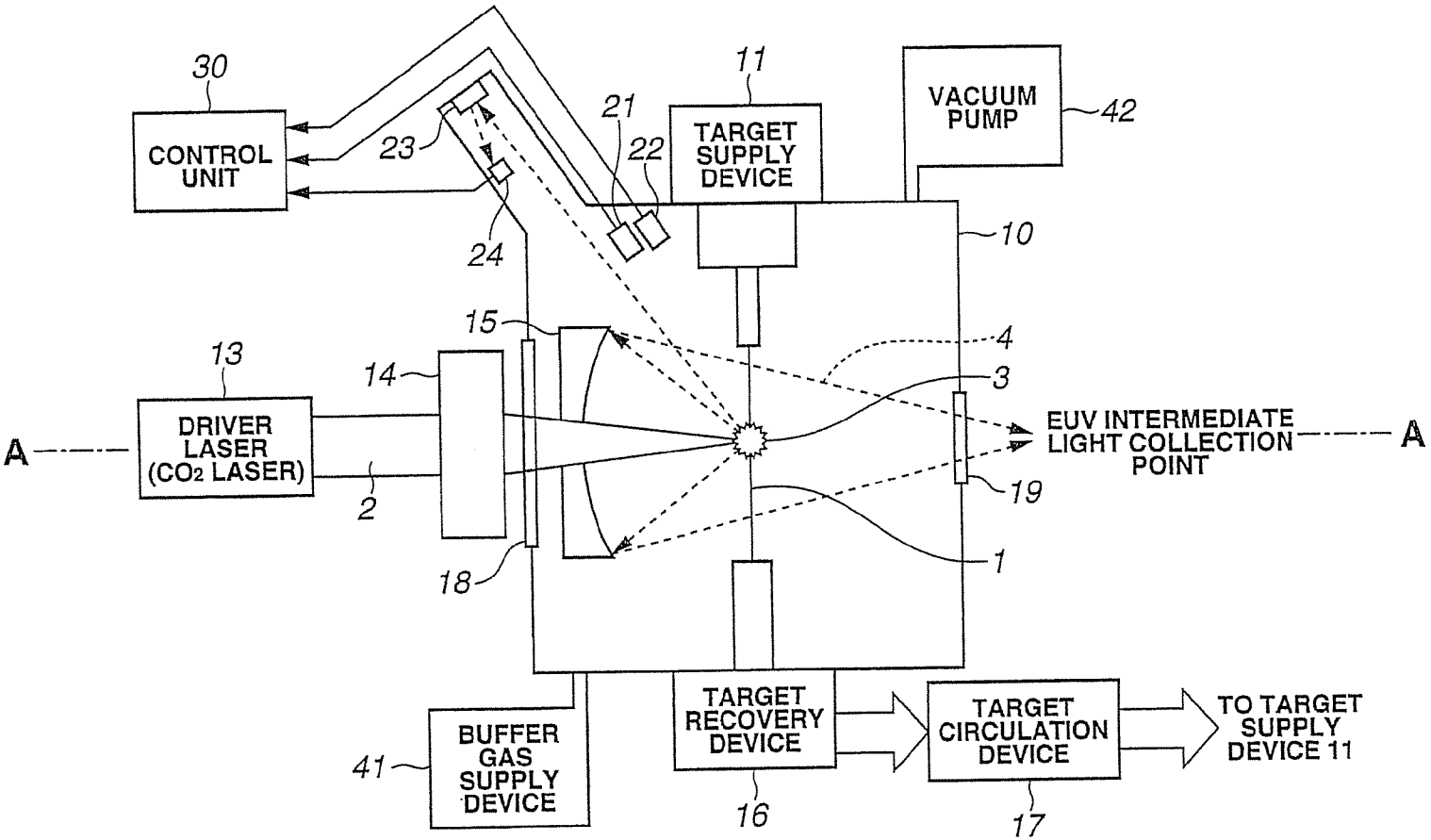
FIG. 6 is a side view illustrating the configuration of the first embodiment.
Figure 7:
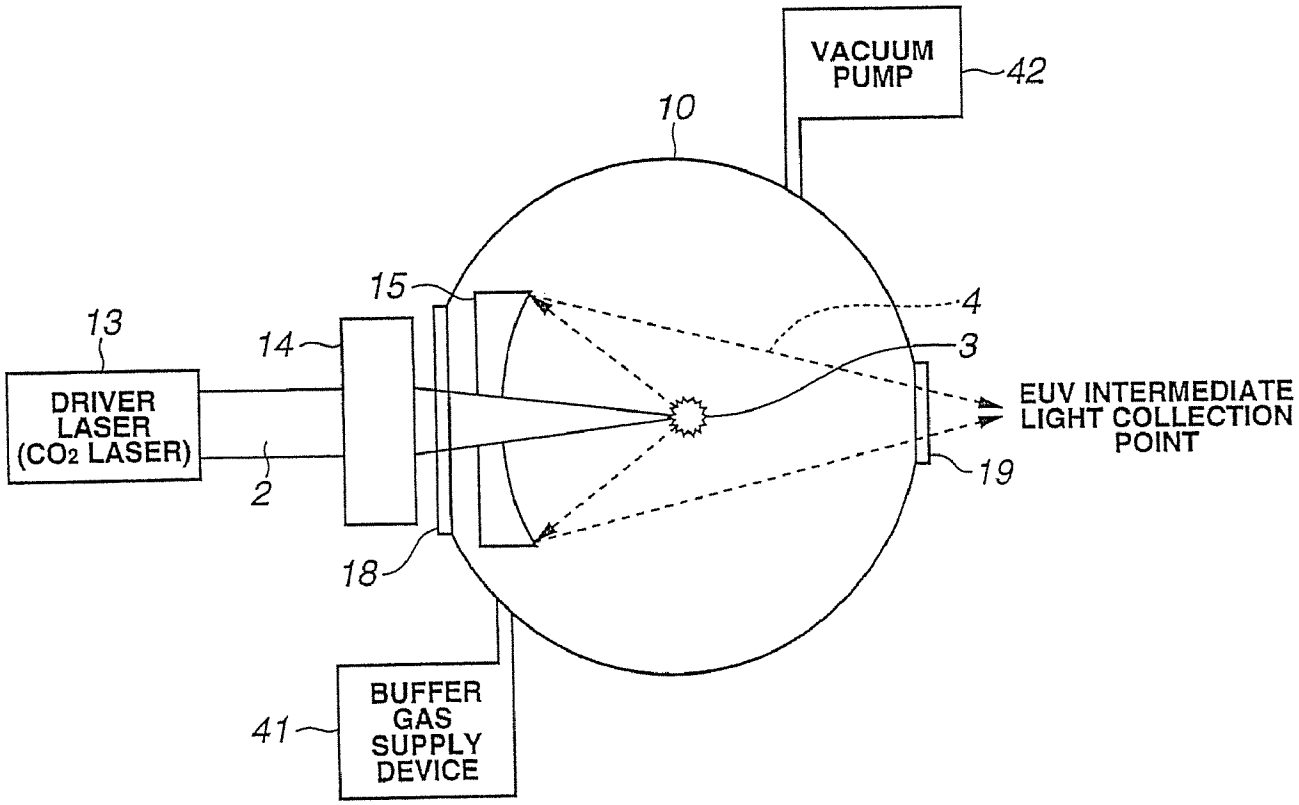
FIG. 7 is an A-A cross-sectional view of the configuration shown in FIG. 6.

FIG. 6 is a side view illustrating the configuration of the first embodiment. FIG. 7 is an A-A cross-sectional view of the configuration shown in FIG. 6. In FIG. 6 and FIG. 7, components identical to those of FIG. 1 and FIG. 2 are assigned with identical reference symbols and the explanation thereof is herein omitted.

In the present embodiment, the action preventing the nanosize scattered material from reaching an optical element is realized by using a background gas. Thus, the background gas is supplied into a vacuum chamber and the background gas particles are caused to collide with the debris thereby reducing the kinetic energy of the debris.

A buffer gas supply device 41 and a vacuum pump 42 are connected to a vacuum chamber 10. The buffer gas supply device 41 supplies a predetermined amount of a background gas (buffer gas) into the vacuum chamber 10. Further, the buffer gas supply device 41 comprises a flow rate control unit such as a mass flow-meter, and this flow rate control unit controls the flow rate of the buffer gas so as to maintain a desired level of vacuum within the vacuum chamber 10. He, Ar, Kr, and the like that absorb little EUV light can be considered as kinds of buffer gas, but other gases may be also used. The vacuum pump 42 evacuates the vacuum chamber 10 at all times and recovers debris together with the buffer gas. For example, the inside of the vacuum chamber 10 is evacuated to about 2 to 3 Pa when Ar gas is used, the propagation distance of EUV light is set to 1 m, and the absorption of EUV light is wished to be 10% or less.

With the present embodiment, the nanosize debris flying from plasma 3 toward a EUV collector mirror 15 collides with gas particles of the buffer gas. As a result, the kinetic energy of the debris is reduced and the debris is eventually sucked in together with the buffer gas by the vacuum pump 42. Therefore, practically no debris reaches the EUV collector mirror 15. As a result, no metal film is formed on the EUV collector mirror 15.

Embodiment 2

Figure 8:
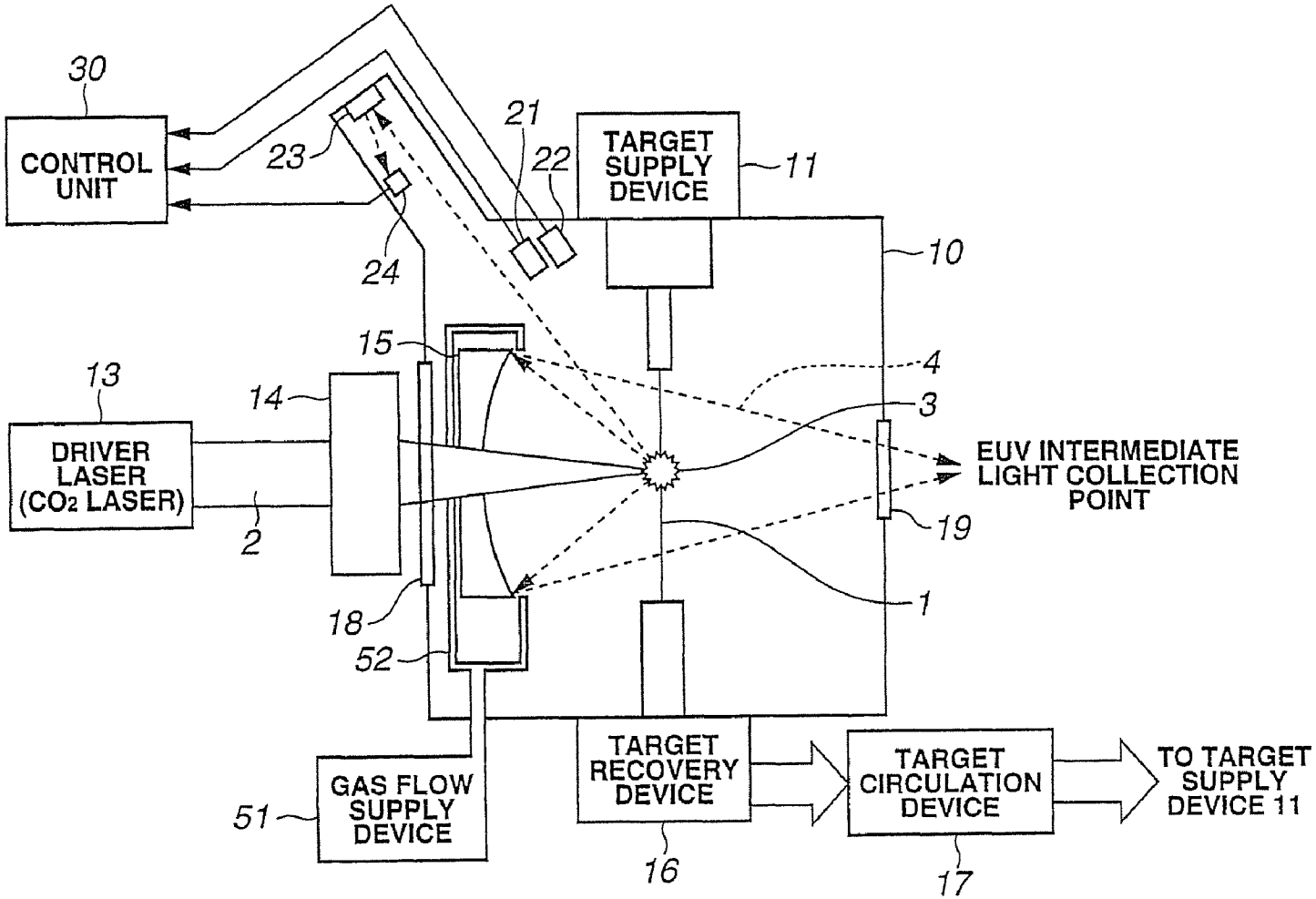
FIG. 8 illustrates the configuration of the second embodiment.

FIG. 8 illustrates the configuration of the second embodiment. In FIG. 8, components identical to those of FIG. 1 and FIG. 2 are assigned with identical reference symbols and the explanation thereof is herein omitted.

In the present embodiment, the action preventing the nanosize scattered material from reaching an optical element is realized by using a gas flow. Thus, a gas flow is created between a plasma generation region and an optical element, and the debris flying toward the optical element is blown off.

A gas flow supply device 51 and a vacuum pump 42 are connected to a vacuum chamber 10. The gas flow supply device 51 is connected to a gas pipe 52, and a release end of the gas pipe 52 is provided close to a reflective surface of an EUV collector mirror 15. It is preferred that the release ends of the gas pipe 52 be provided in a plurality of places, so that the entire reflective surface of the EUV collector mirror 15 be covered with the gas flow. Further, a drive device that operates the release end to change the direction of gas flow may be also provided. Where gas is supplied from the gas flow supply device 51, the gas flow is generated along the reflective surface of the EUV collector mirror 15. The gas flow supply device 51 is substantially identical to the buffer gas supply device 41, but the gas ejection pressure has to be sufficient to blow off the nanosize debris that aims to reach the reflective surface of the EUV collector mirror 15. Similarly to the first invention, He, Ar, Kr, and the like that absorb little EUV light can be considered as kinds of buffer gas, but other gases may be also used.

In the present embodiment, the nanosize debris flying from the plasma 3 toward the EUV collector mirror 15 is blown off from the vicinity of the reflective surface of the EUV collector mirror 15 by the gas flowing along the reflective surface of the EUV collector mirror 15. Therefore, practically no debris reaches the EUV collector mirror 15. As a result, no metal film is formed on the EUV collector mirror 15.

In the present embodiment, a gas flow is generated in the vicinity of the EUV collector mirror 15, but a gas flow may be also generated in the vicinity of each optical element by providing a release end of the gas pipe 52 close to the surface of other optical elements or devices comprising optical elements that are provided within the vacuum chamber 10, for example, an inlet window 18, an outlet window 19, a mirror damage detector 21, an ion detector 22, a multilayer film mirror 23, or an EUV light detector 24.

Where the inside of the vacuum chamber 10 is filled with gas, while controlling the flow rate of gas supplied from the gas flow supply device 51, it is possible to perform an action identical to that of the first embodiment.

Embodiments in which the debris is deflected with a magnetic field or an electric field will be described below. Prior to the explanation of these embodiments, the relationship between the particle diameter and deflection effect will be considered.

For example, when a particle is charged, the upper limit value of the electric charge is determined by the Rayleigh equation:

$$Q=(64\pi^2\epsilon_0 r^3\sigma)^{1/2} \quad (1)$$

where $\epsilon_0$ is a dielectric constant, r is a particle radius and $\sigma$ is a surface tension.

Further, the particle mass is determined by the following equation:

$$M=4/3r^3\rho \quad (2)$$

where $\rho$ is a substance density.

Equation (1) shows that the electric charge Q is proportional to a 3/2 power of the particle radius r, and Equation (2) shows that the mass M is proportional to a third power of the particle radius r. Therefore, the larger is the particle radius, the smaller is the electric charge related to a mass unit (electric charge divided by the mass). In other words, the larger is the particle diameter, the smaller is the deflection effect produced by an electric field on the charged particle.

Specific computation data will be used below to investigate how the degree of deflection (deflection distance) varies for each particle diameter, the object of the investigation being a tin particle charged to the above-described upper limit of electric charge.

Figure 9:
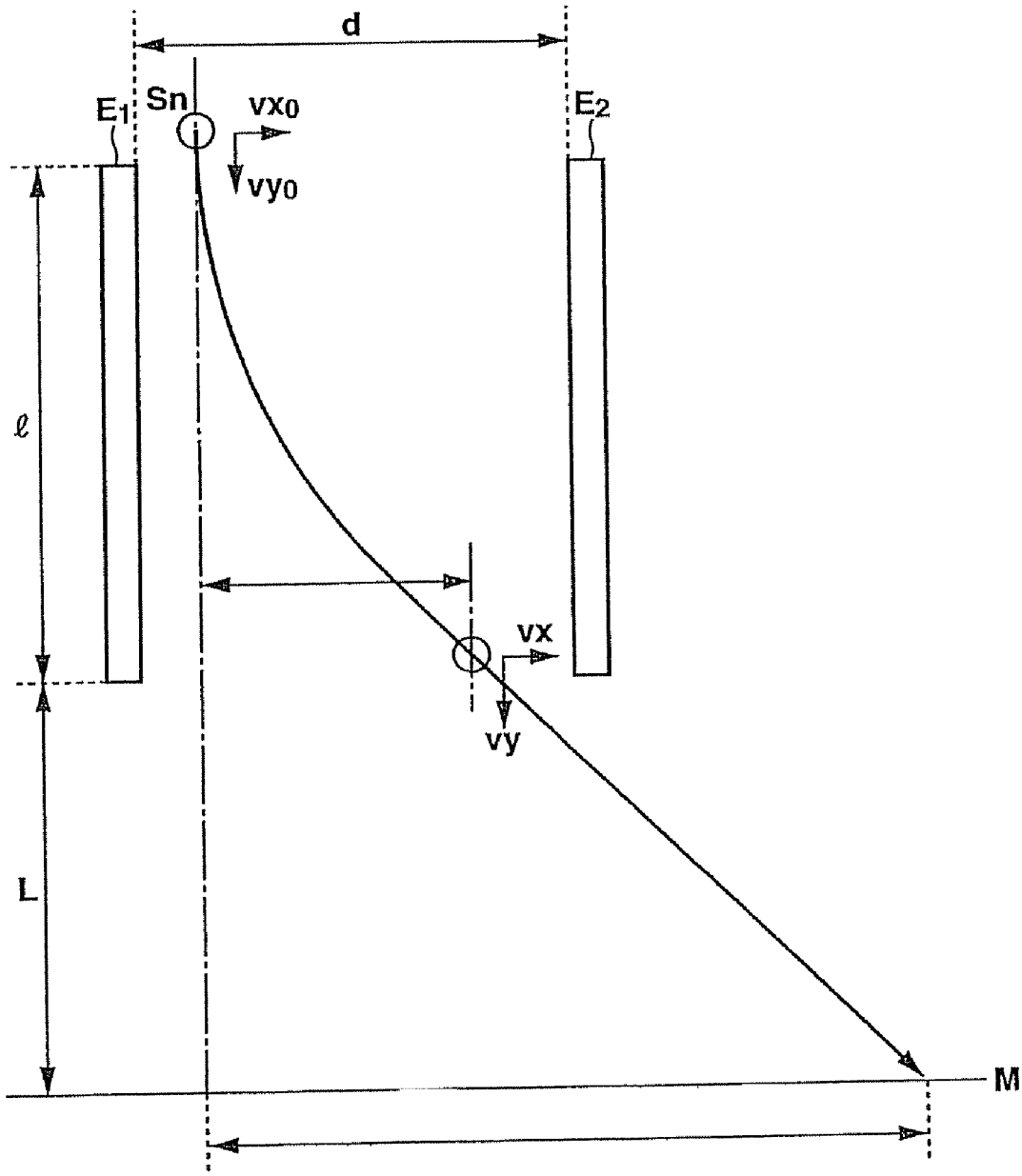
FIG. 9 illustrates a device for investigating the variation in the degree of deflection (deflection distance) for each particle diameter.

The degree to which particulate tin Sn passing between a pair of mutually opposing deflecting electrodes E1, E2 is deflected by an electric field generated between the deflecting electrodes E1, E2 before it reaches the measurement position M, as shown in FIG. 9, will be calculated below. The longitudinal direction of the deflecting electrodes E1, E2 will be taken as an x direction, and the direction in which the electrodes E1, E2 face each other will be taken as y direction. Further, FIG. 10 shows the deflection distance of tin Sn with a particle diameter of 1 μm, 10 μm, 100 μm obtained when an x component vx0=0 m/s and y component vy0=15 m/s from among the components of initial velocity of tin Sn, the electrode length in the longitudinal direction of deflecting electrodes E1, E2 is 1=20 mm, the spacing between the deflecting electrodes E1, E2 is d=10 mm, the distance from the end portion of the deflecting electrodes E1, E2 to the measurement position M is L=50 mm, and the deflection voltage V=100 V.

According to FIG. 10, tin Sn with a particle diameter of 1 μm is deflected (moved) by about 290 mm in the y direction in the measurement position M, whereas tin Sn with a particle diameter of 10 μm is deflected only by about 9 mm in the y direction in the measurement position M and tin Sn with particle diameter of 100 μm is deflected by merely about 0.3 mm in the y direction in the measurement position M. These data demonstrate that the electric charge related to a mass unit (electric charge divided by the mass) decreases and the deflection distance also decreases with the increase in particle diameter. These data have been verified with respect to the deflection distance of microsize particles, but the deflection distance of nanosize particles will be even larger than that of tin Sn of a 1 μm size. For example, where the same computations are conducted with respect to a particle with a diameter of 10 nm, the deflection distance in the measurement position will increase by an order of magnitude to $1.4\times10^{11}$ mm. Embodiments in which nanosize debris is electrically charged and an electric field or a magnetic field is caused to act thereupon will be described below.

Embodiment 3

Figure 11:
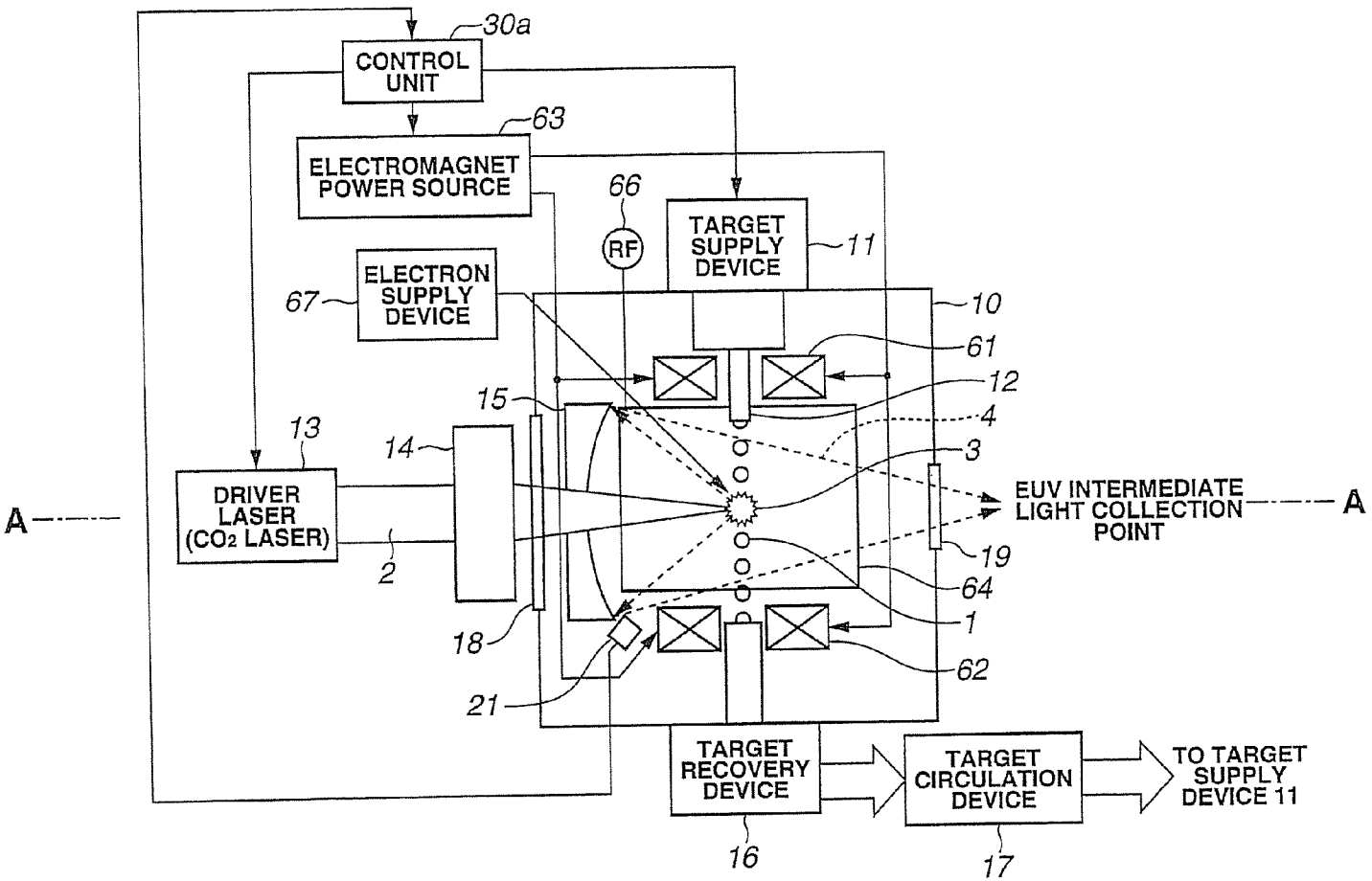
FIG. 11 is a side view illustrating the configuration of the third embodiment.
Figure 12:
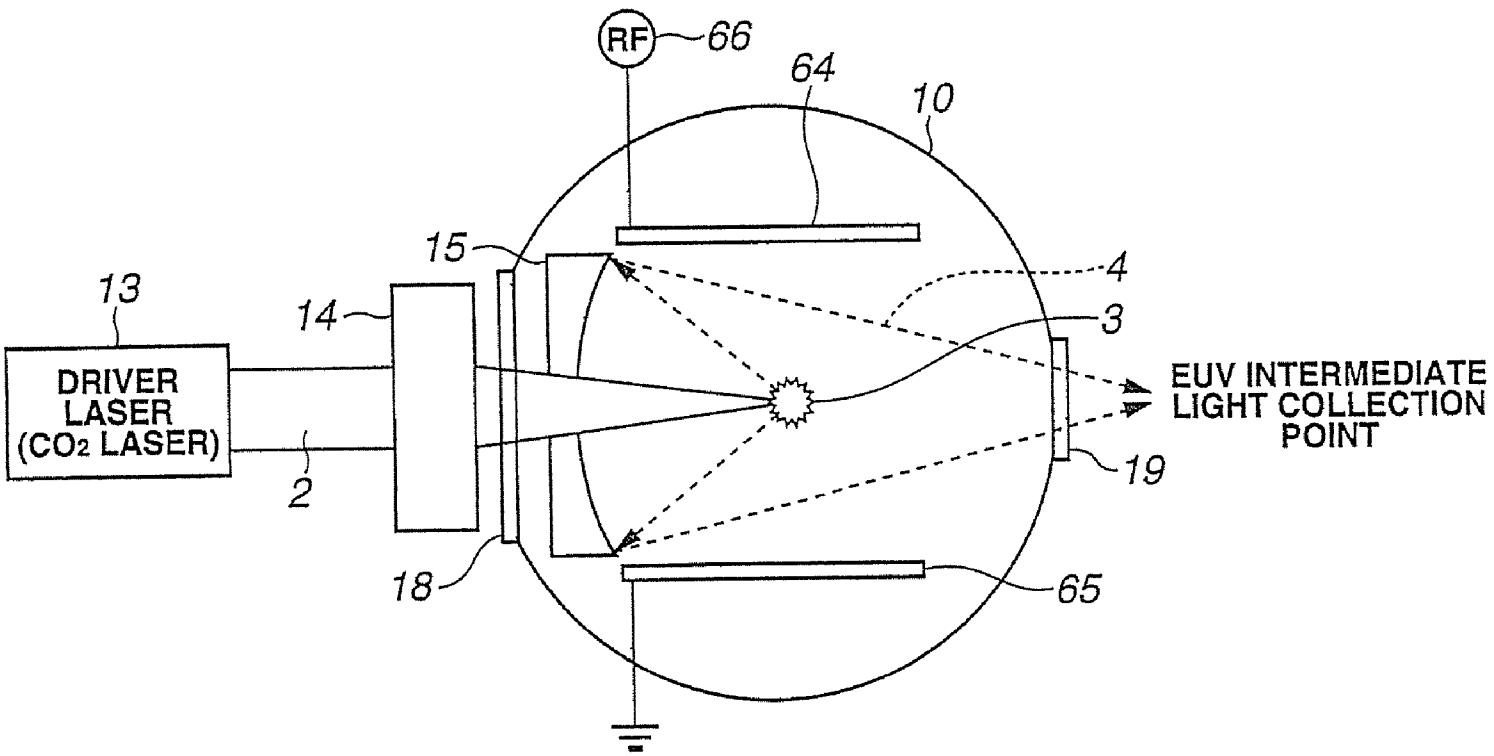
FIG. 12 is an A-A cross-sectional view of the configuration shown in FIG. 11.

FIG. 11 is a side view illustrating the configuration of the third embodiment. FIG. 12 is an A-A cross-sectional view of the configuration shown in FIG. 11. In FIG. 11 and FIG. 12, components identical to those of FIG. 1 and FIG. 2 are assigned with identical reference symbols and the explanation thereof is herein omitted. In FIG. 11, to save some space in the figure, the ion detector 22, multilayer film mirror 23, and EUV light detector 24 shown in FIG. 1 are omitted.

In the present embodiment, the action preventing the nanosize scattered material from reaching an optical element is realized by using a magnetic field. Thus, the debris is electrically charged, a magnetic field is generated between the plasma generation region and an optical element, and the debris flying toward the optical element is deflected.

Electromagnetic coils 61, 62 that generate a magnetic field within the generation region of plasma 3 and plasma electrodes 64, 65 that generate in the generation region of plasma 3 a plasma that is different from the plasma 3 generated by the laser beam are provided within a vacuum chamber 10. Further, a control unit 30*a* in which an electromagnet control function is added to the functions of the control unit 30 shown in FIG. 1 is also provided.

The electromagnetic coils 61, 62 are provided opposite each other with a light emission point of a target 1 being therebetween, and the two coils are electrically connected to an electromagnetic power source 63. The electromagnetic power source 63 magnetizes the electromagnetic coils 61, 62 in response to a command from the control unit 30*a*. The control unit 30*a* controls the electromagnetic power source 63 so that a desired magnetic field is generated in the generation region of plasma 3. Permanent magnets or superconductive magnets may be provided instead of the electromagnetic coils 61, 62.

The plasma electrodes 64, 65 are provided opposite each other with a light emission point of a target 1 being therebetween. The plasma electrode 64 is electrically connected to an RF power source 66, and the plasma electrode 65 is grounded. The RF power source 66 applies a high voltage between the plasma electrode 64 and the plasma electrode 65. The plasma electrodes 64, 65 and the RF power source 65 of the present embodiments are of a CCP (capacitive coupled plasma) system, but a configuration generating plasma with another system may be also employed. For example, systems such as ECR (electron cyclotron resonance plasma), HWP (helicon wave plasma), ICP (inductively coupled plasma), and SWP (surface wave plasma) can be also employed.

The control unit 30*a* controls the timing at which the driver layer 13 generates a laser beam, the timing at which the target supply device 11 supplies the target 1, and the timing at which the electromagnet power source 63 supplies an electric current to the electromagnetic coils 61, 62.

An electron supply device 67 that supplies electrons to the generation region of plasma 3 may be provided in a desired position. With the electron supply device 67, the ionization efficiency of debris with the plasma electrodes 64, 65 can be increased. For example, an electron gun can be used as the electron supply device. An ultraviolet ionizer may be provided instead of the electron supply device 67.

With the present embodiment, the nanosize debris flying from the plasma 3 toward the EUV collector mirror 15 is electrically charged (ionized) by the plasma generated by the plasma electrodes 64, 65. The debris that has thus been ionized is acted upon by an asymmetric magnetic field generated between the electromagnetic coils 61, 62 and deflected in the direction of magnetic lines. Therefore, practically no debris reaches the EUV collector mirror 15. As a result, no metal film is formed on the EUV collector mirror 15.

Embodiment 4

Figure 13:
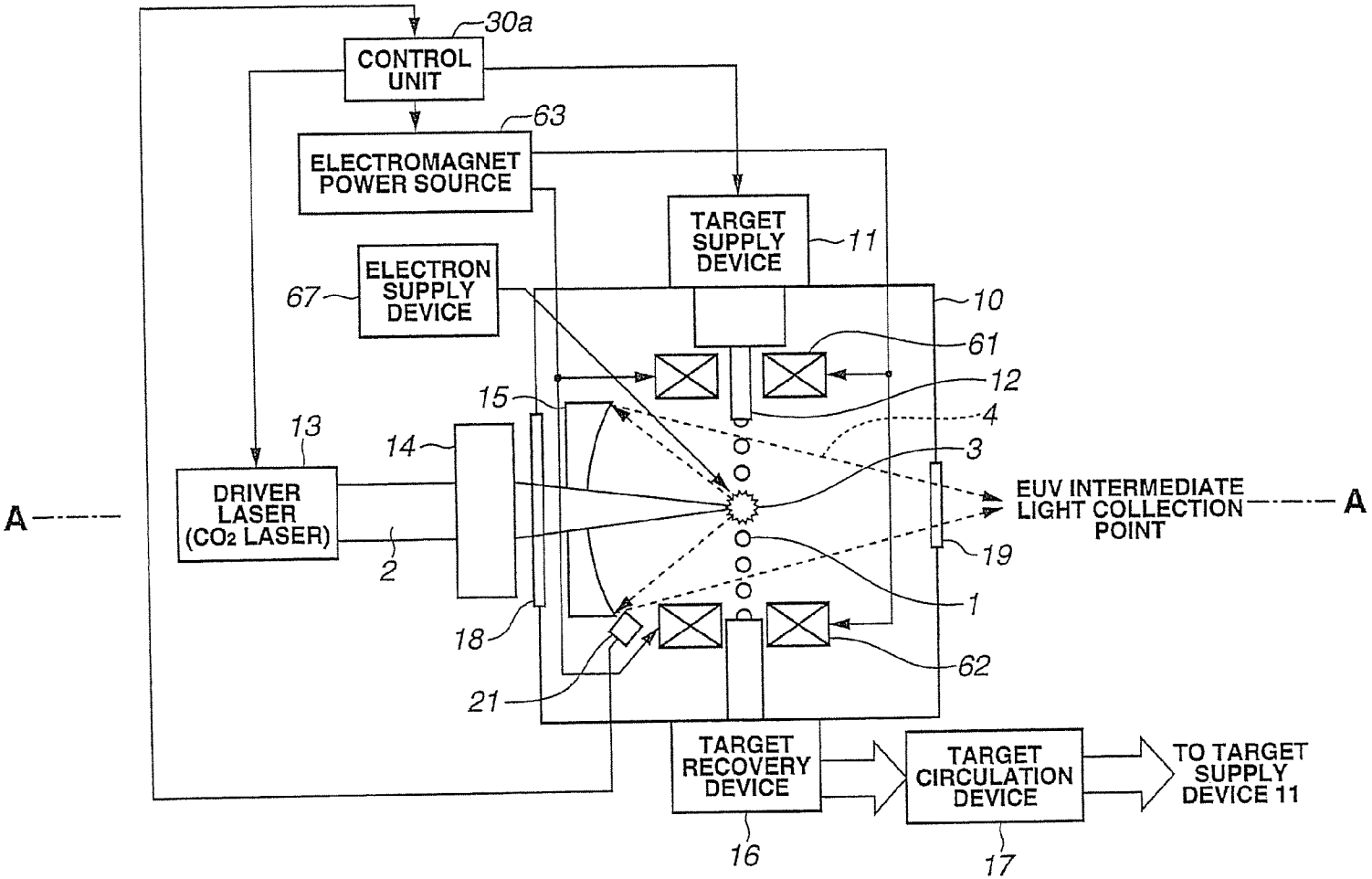
FIG. 13 illustrates the configuration of the fourth embodiment.

FIG. 13 illustrates the configuration of the fourth embodiment. In FIG. 13, components identical to those of FIG. 1, FIG. 2 and FIG. 11, FIG. 12 are assigned with identical reference symbols and the explanation thereof is herein omitted. In FIG. 13, to save some space in the figure, the ion detector 22, multilayer film mirror 23, and EUV light detector 24 shown in FIG. 1 are omitted.

The difference between the present embodiment and the third embodiment is only in the means for electrically charging the debris. In the present embodiment, similarly to the third embodiment, the action preventing the nanosize scattered material from reaching an optical element is realized using a magnetic field. Thus, the debris is electrically charged and a magnetic field is generated between the plasma generation region and the optical element, thereby deflecting the debris flying toward the optical element.

In the third embodiment, the debris is electrically charged by generating plasma, e.g. of a CCP system, in the generation region of plasma 3, but in the present embodiment, the generation region of plasma 3 is irradiated with an electron beam from and electron supply device 67, thereby electrically charging the debris. The debris can be electrically charged by irradiation with an electron beam via the attachment of electrons to the debris or induction of secondary electron emission therefrom. For example, an electron gun can be used as the electron supply device 67. An electron gun can be of a thermal electron emission type or of a field emission type, and the electron gun of any type may be used.

With the present embodiment, the nanosize debris flying from the plasma 3 toward the EUV collector mirror 15 is electrically charged (ionized) by the electron beam irradiated by the electron supply device 67. The debris that has thus been ionized is acted upon by an asymmetric magnetic field generated between the electromagnetic coils 61, 62 and deflected in the direction of magnetic lines. Therefore, practically no debris reaches the EUV collector mirror 15. As a result, no metal film is formed on the EUV collector mirror 15.

Embodiment 5

Figure 14:
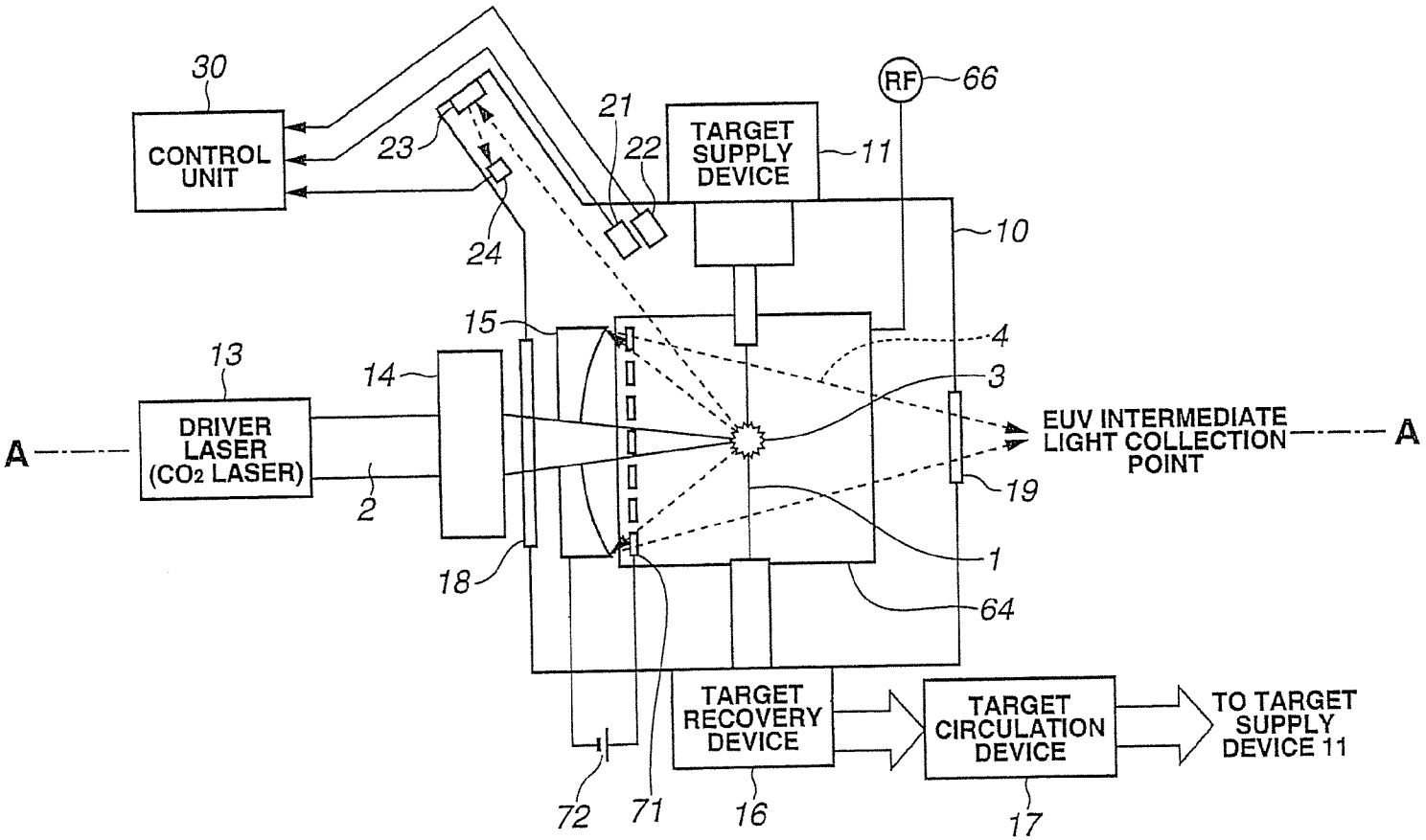
FIG. 14 is a side view illustrating the configuration of the fifth embodiment.
Figure 15:
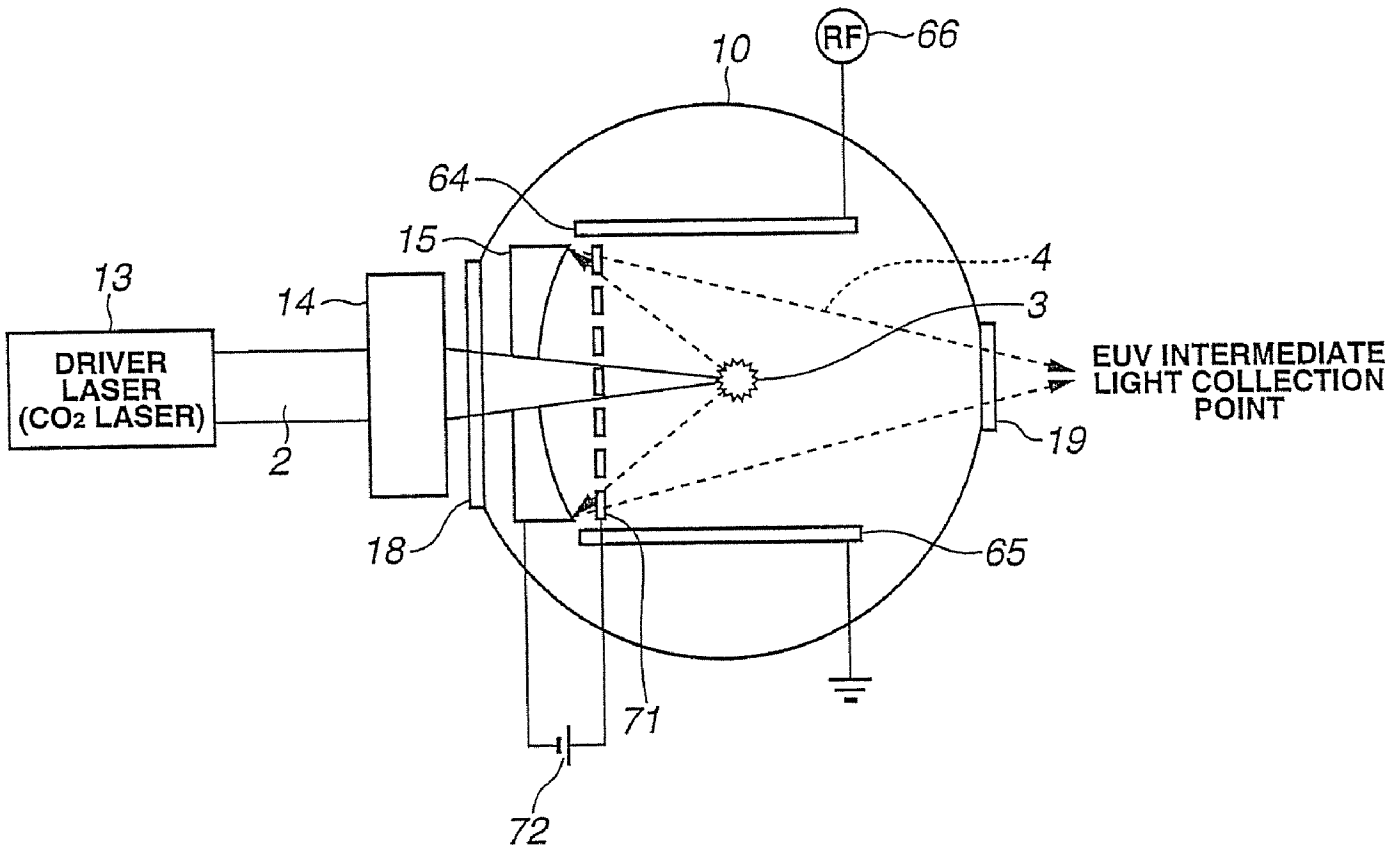
FIG. 15 is an A-A cross-sectional view of the configuration shown in FIG. 14.

FIG. 14 is a side view illustrating the configuration of the fifth embodiment. FIG. 15 is an A-A cross-sectional view of the configuration shown in FIG. 14. In FIG. 14 and FIG. 15, components identical to those of FIG. 1, FIG. 2 and FIG. 11, FIG. 12 are assigned with identical reference symbols and the explanation thereof is herein omitted.

In the present embodiment, the action preventing the nanosize scattered material from reaching an optical element is realized by using an electric field. Thus, the debris is electrically charged, an electric field is generated between the plasma generation region and an optical element, and the debris flying toward the optical element is deflected.

A grid electrode 71 that generates an electric field in the vicinity of the reflective surface of an EUV collector mirror 15 and plasma electrodes 64, 65 that generate in the generation region of plasma 3 a plasma that is different from the plasma 3 generated by the laser beam are provided within a vacuum chamber 10. Further, similarly to the third embodiment, an electron supply device 67 that supplies electrons to the generation region of plasma 3 may be provided in a desired position.

The grid electrode 71 is provided to face the reflective surface of the EUV collector mirror 15 between the EUV collector mirror 15 and the generation region of plasma 3. The grid electrode 71 has a grid-like shape and, therefore, does not inhibit the EUV light. A positive terminal of a DC power source 72 is connected to the grid electrode 71, and a negative terminal of the DC power source 72 is connected to the EUV collector mirror 15. With such a configuration, an electric field is generated between the EUV collector mirror 15 and the grid electrode 71. Further, in order to protect the mirror from the ions generated from plasma, it is preferred that neutral particles be positively charged by the plasma electrodes 64, 65. However, in the cases where the neutral particles cannot be charged positively due to the generation state of the neutral particles, the polarity of electric field may be inverted to resolve this problem associated with the neutral particles.

With the present embodiment, the nanosize debris flying from the plasma 3 toward the EUV collector mirror 15 is electrically charged (ionized) by the plasma generated by the plasma electrodes 64, 65. The debris that has thus been ionized is acted upon and repulsed by an electric field generated between the EUV collector mirror 15 and grid electrode 71. Therefore, practically no debris reaches the EUV collector mirror 15. As a result, no metal film is formed on the EUV collector mirror 15.

In the present embodiment, an electric field is generated in the vicinity of the EUV collector mirror 15, but an electric field similar to that of the present embodiment may be also generated by providing a grid electrode close to the surface of other optical elements or devices comprising optical elements that are provided within the vacuum chamber 10, for example, an inlet window 18, an outlet window 19, a mirror damage detector 21, an ion detector 22, a multilayer film mirror 23, or an EUV light detector 24.

Further, it is also possible to provide another electrode in the vicinity of the EUV collector mirror 15, rather than use the EUV collector mirror 15 itself as an electrode.

Embodiment 6

Figure 16:
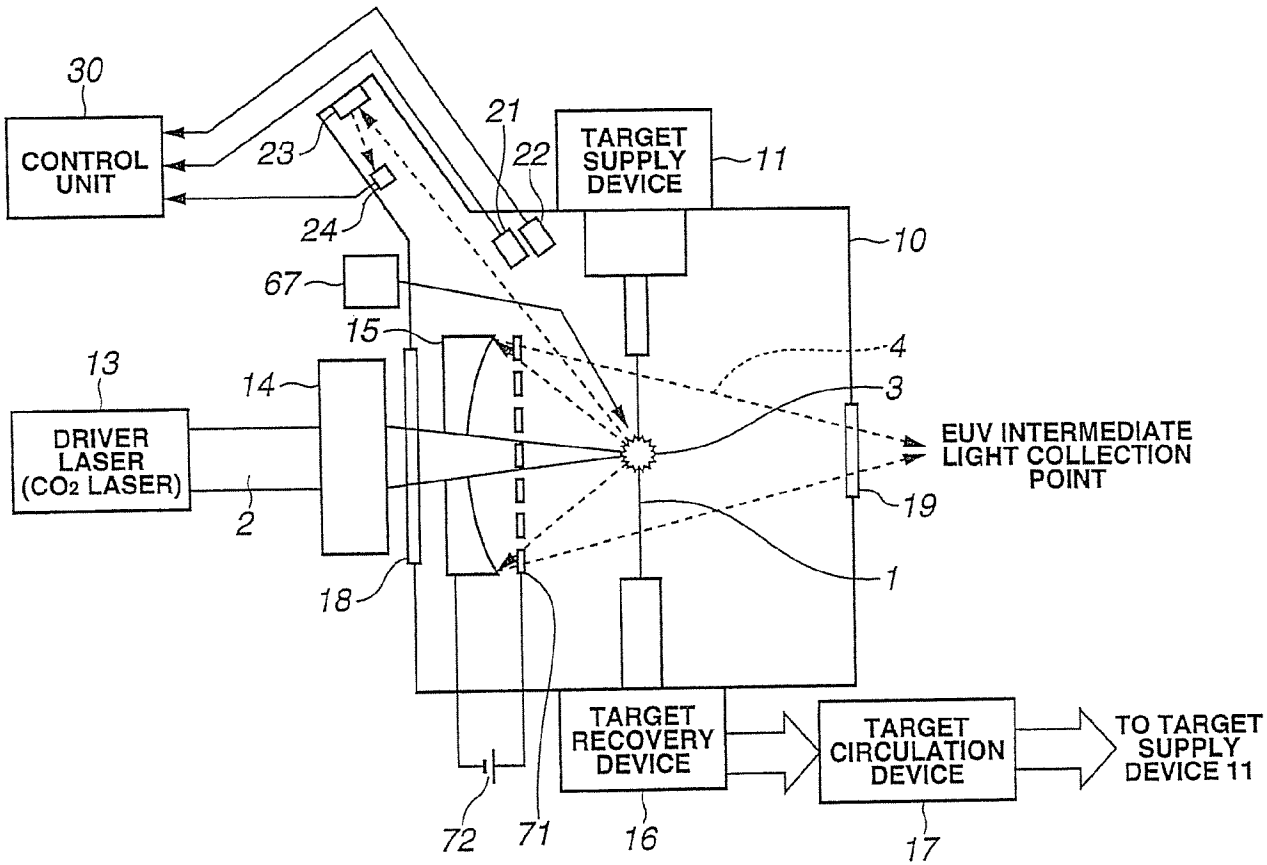
FIG. 16 illustrates the configuration of the sixth embodiment.

FIG. 16 illustrates the configuration of the sixth embodiment. In FIG. 16, components identical to those of FIG. 1, FIG. 2 and FIG. 14, FIG. 15 are assigned with identical reference symbols and the explanation thereof is herein omitted.

The difference between the present embodiment and the fifth embodiment is only in the debris charging means. In the present embodiment, similarly to the fifth embodiment, the action preventing the nanosize scattered material from reaching an optical element is realized by using an electric field. Thus, the debris is electrically charged, an electric field is generated between the plasma generation region and an optical element, and the debris flying toward the optical element is deflected.

In the fifth embodiment, the debris is electrically charged by generating plasma, e.g. of a CCP system, in the generation region of plasma 3, but in the present embodiment, the generation region of plasma 3 is irradiated with an electron beam from an electron supply device 67, thereby electrically charging the debris. The debris can be electrically charged by irradiation with an electron beam via the attachment of electrons to the debris or induction of secondary electron emission therefrom. For example, an electron gun can be used as the electron supply device 67. An electron gun can be of a thermal electron emission type or of a field emission type, and the electron gun of any type may be used.

With the present embodiment, the nanosize debris flying from the plasma 3 toward the EUV collector mirror 15 is electrically charged (ionized) by the electron beam irradiated by the electron supply device 67. The debris that has thus been ionized is acted upon and repulsed by an electric field generated between the EUV collector mirror 15 and grid electrode 71. Therefore, practically no debris reaches the EUV collector mirror 15. As a result, no metal film is formed on the EUV collector mirror 15.

Embodiment 7

Figure 17:
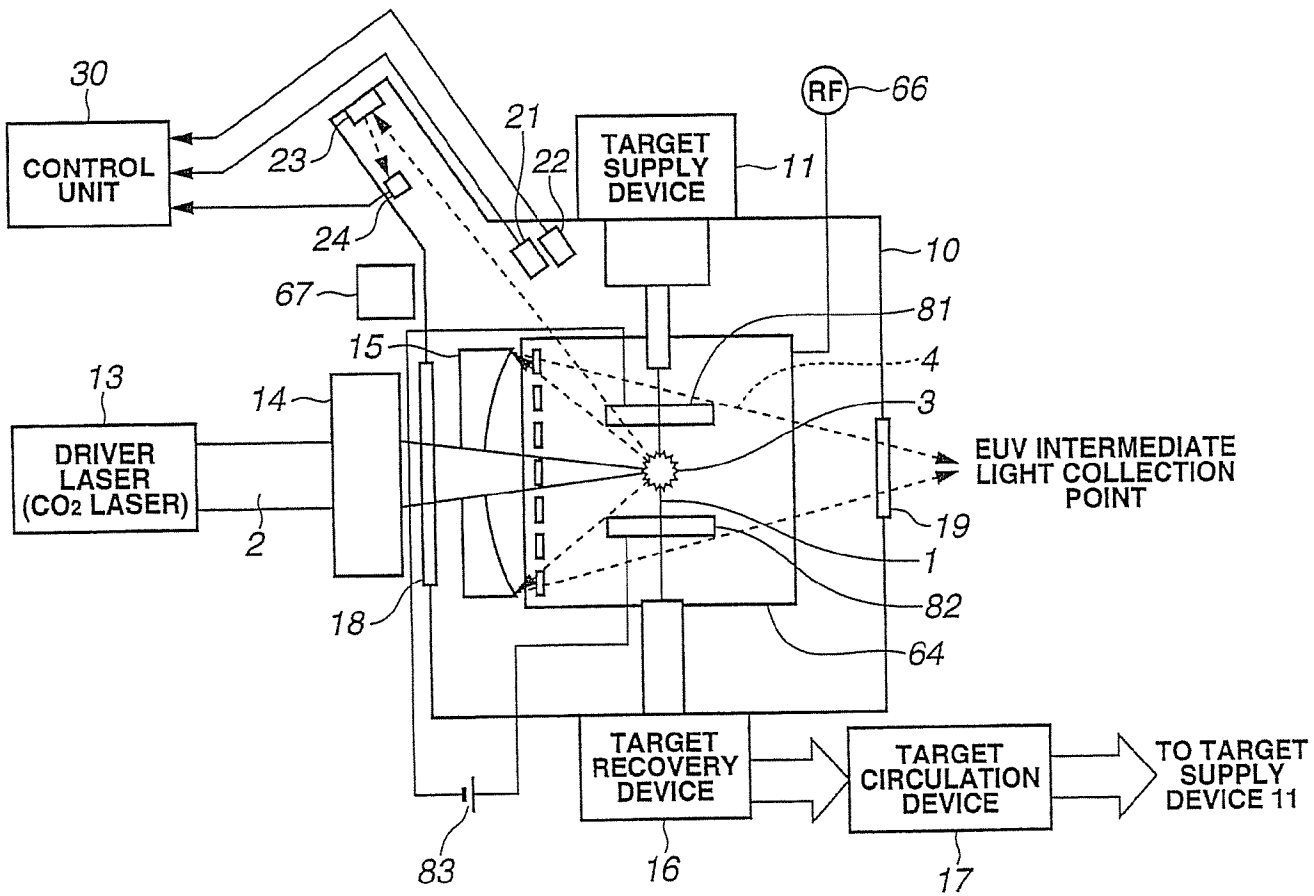
FIG. 17 illustrates the configuration of the seventh embodiment.

FIG. 17 illustrates the configuration of the seventh embodiment. In FIG. 17 components identical to those of FIG. 1, FIG. 2 and FIG. 13, FIG. 14 are assigned with identical reference symbols and the explanation thereof is herein omitted.

In the present embodiment, the action preventing the nanosize scattered material from reaching an optical element is realized by using an electric field. Thus, the debris is electrically charged, an electric field is generated between the plasma generation region and an optical element, and the debris flying toward the optical element is deflected.

A pair of deflecting electrodes 81, 82 that generate an electric field in a generation region of plasma 3 and plasma electrodes 64, 65 that generate within the generation region of plasma 3 a plasma that is different from the plasma 3 generated by the laser beam are provided within the vacuum chamber 10. Further, similarly to the fifth embodiment, an electron supply device 67 that supplies electrons to the generation region of plasma 3 may be provided in a desired position.

The deflecting electrodes 81, 82 are provided opposite each other with a light emission point of a target 1 being therebetween and disposed so that the direction of electric field is substantially parallel to the reflective surface of the EUV collector mirror 15. Molybdenum (Mo) or tungsten (W) are preferably used as the materials for deflecting electrodes 81, 82. The deflecting electrodes 81, 82 are electrically connected to a DC power source 83. With such configuration, an electric field is generated between the deflecting electrodes 81, 82.

With the present embodiment, the nanosize debris flying from the plasma 3 toward the EUV collector mirror 15 is electrically charged (ionized) by plasma generated by the plasma electrons 64, 65. The debris that has thus been ionized is acted upon and repulsed by an electric field generated between the deflecting electrodes 81, 82. Therefore, practically no debris reaches the EUV collector mirror 15. As a result, no metal film is formed on the EUV collector mirror 15.

Embodiment 8

Figure 18:
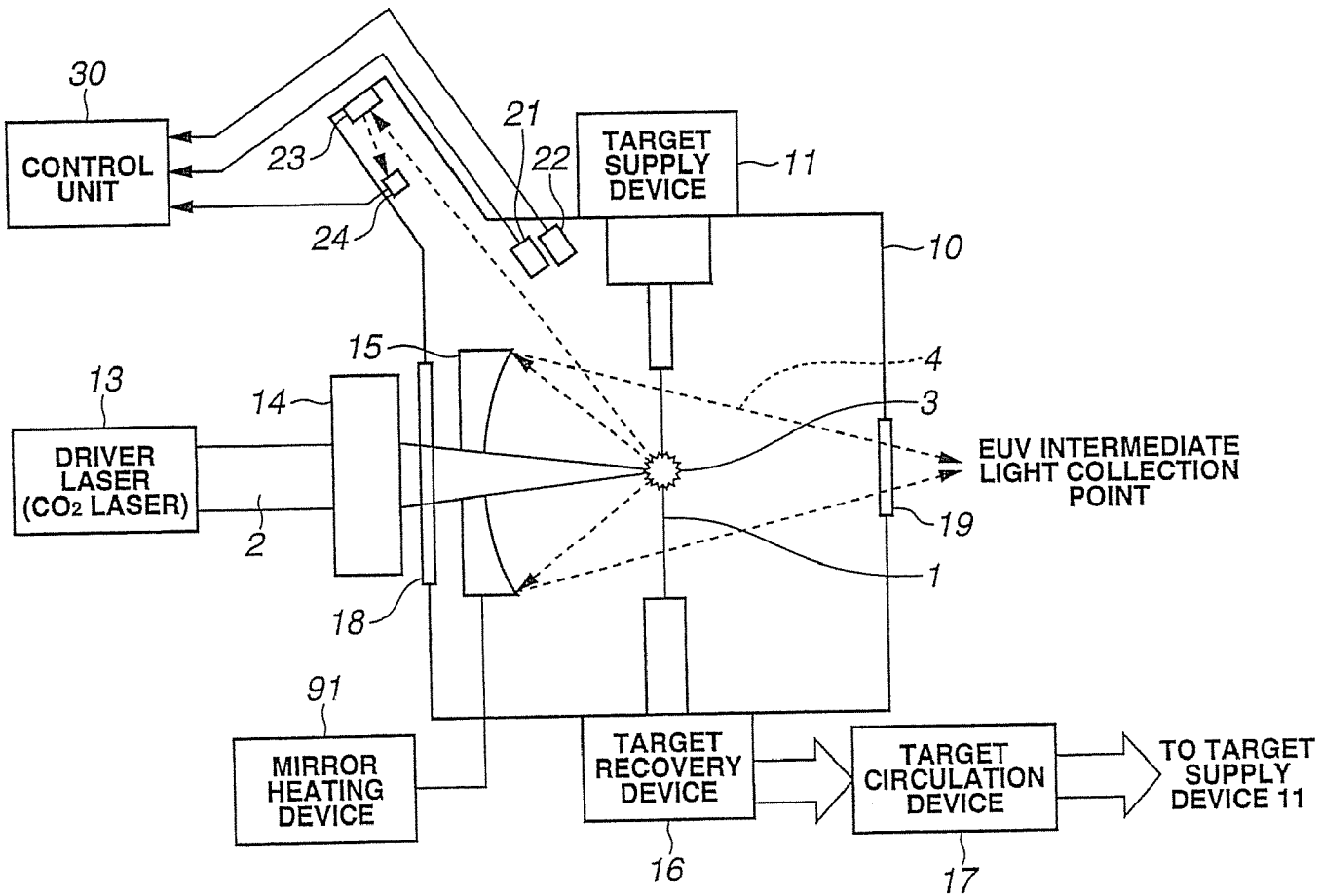
FIG. 18 illustrates the configuration of the eighth embodiment.
Figure 19:
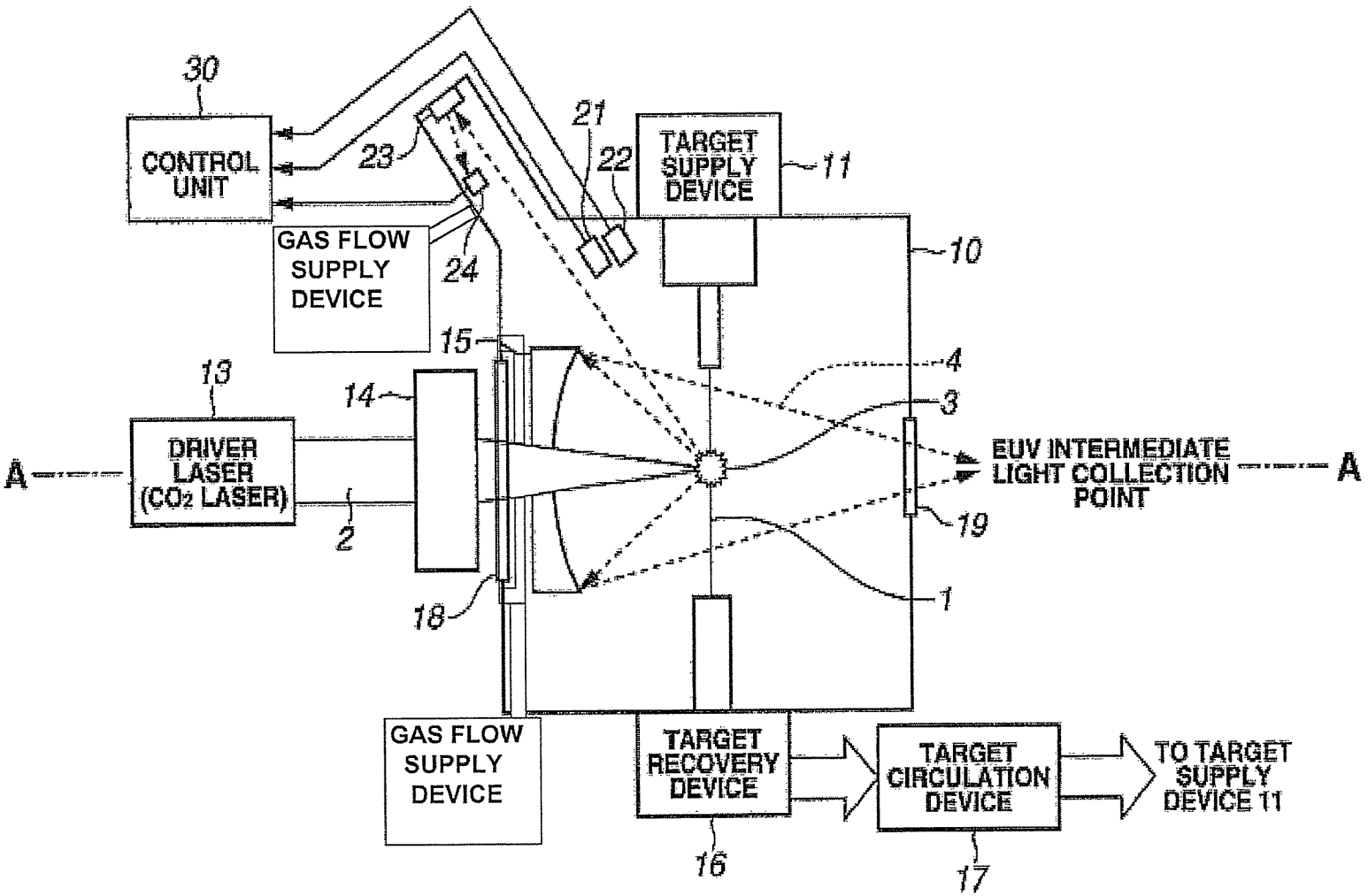
FIG. 19 is a schematic of another embodiment of the subject invention.
Figure 20:
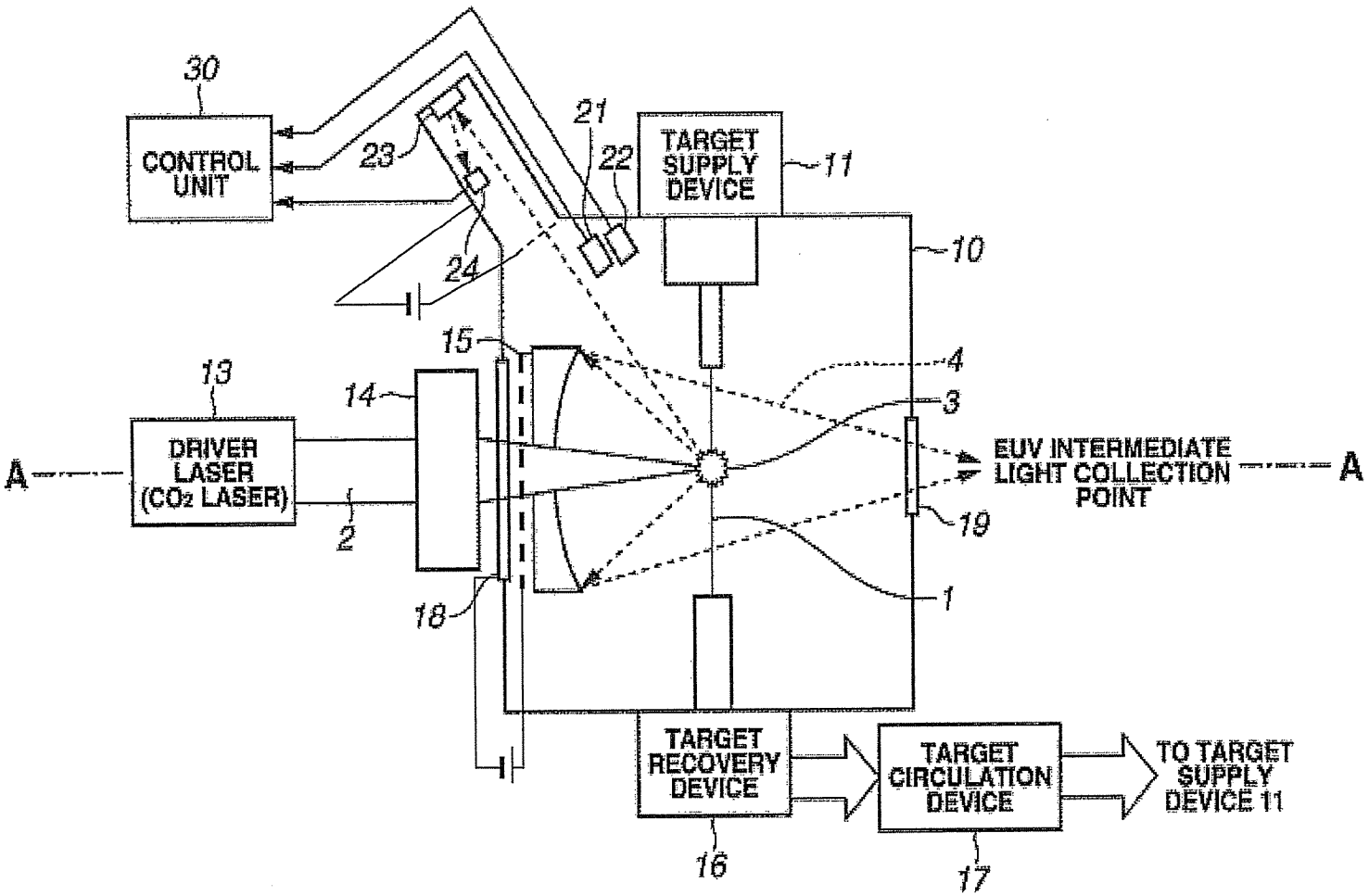
FIG. 20 is a schematic of yet another embodiment of the subject invention.
Figure 21:
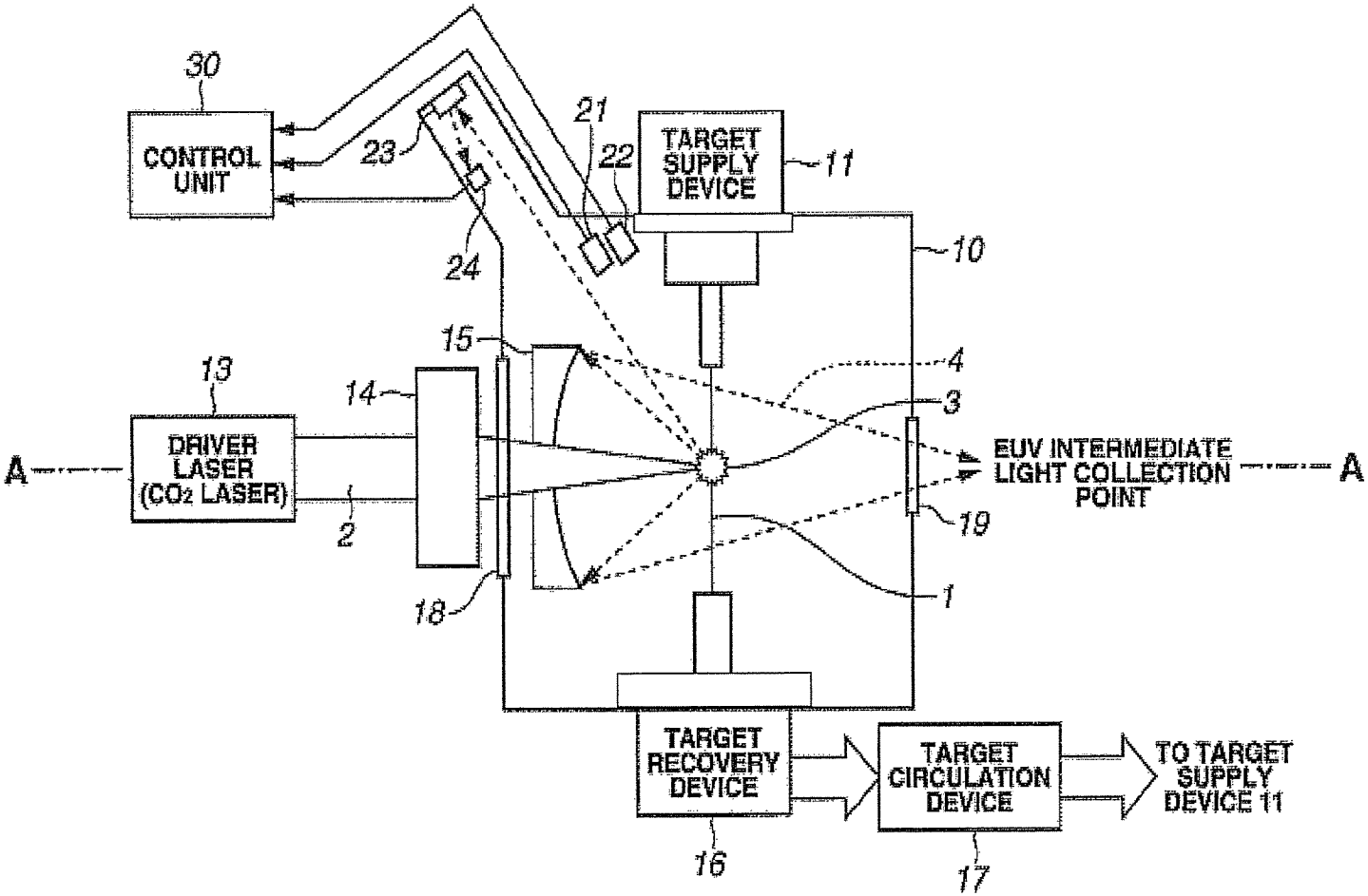
FIG. 21 is a schematic of yet another embodiment of the subject invention.

FIG. 18 illustrates the configuration of the eighth embodiment. In FIG. 18 components identical to those of FIG. 1, FIG. 2 are assigned with identical reference symbols and the explanation thereof is herein omitted.

In the present embodiment, the action preventing the nanosize scattered material from reaching an optical element is realized by using a diffusion effect (evaporation). Thus, the debris flying toward an optical element is heated and evaporated.

A mirror heater device 91 is connected to an EUV collector mirror 15. The mirror heating device 91 controls the temperature of the EUV collector mirror 15 so that it assumes a desired level. In order to evaporate nanosize debris, it is preferred that the EUV collector mirror 15 be maintained at about 400° C. Another heating member may be provided within a vacuum chamber 10, instead of heating the EUV collector mirror 15.

With the present embodiment, the nanosize debris flying from the plasma 3 toward the EUV collector mirror 15 is heated and evaporated in the vicinity of the EUV collector mirror 15. Therefore, practically no debris reaches the EUV collector mirror 15. As a result, no metal film is formed on the EUV collector mirror 15.

The above-described first to eighth embodiments can be also appropriately combined.

The embodiments are applicable not only to an EUV collector mirror, but also to optical elements within a vacuum chamber. For example, by applying the embodiments to optical elements of a sensor class, the decrease in sensitivity caused by adhesion of debris can be prevented.

What is claimed is:

1. An optical element contamination preventing device for an extreme ultraviolet light source apparatus wherein a scattered material emitted together with extreme ultraviolet light from a first plasma generated by excitation of a target within a chamber by a laser beam is prevented from contaminating an optical element or an equipment having an optical element within the chamber, wherein at least a surface of the target is made of tin and the target has a tape-shape, a wire-shape, a plate-shape, a rod-shape or a ball-shape;

a wavelength of the laser beam is $CO_2$ laser wavelength, and the laser is configured to reduce most of the scattered material to sub-nanometer size;

the optical element comprises a collector mirror that reflects and collects the extreme ultraviolet light emitted from the plasma;

the optical element comprises a laser window for guiding the laser beam into the chamber:

wherein the device comprises;

a plasma generating device for generating a second plasma for electrically charging the scattered material;

a magnetic field generating device for applying a magnetic field to the electrically charged scattered material for deflecting the scattered material, thereby preventing the scattered material from reaching the optical element; and gasflow generating means for generating a gasflow in the vicinity of the optical element.

2. The optical element contamination preventing device for an extreme ultraviolet light source apparatus according to claim 1, wherein the plasma generating device generates the second plasma in a plasma generating region where the first plasma is generated by the $CO_2$ laser, and the plasma generating device comprises a plurality of electrodes and a power source connected to the plurality of the electrodes.

3. The optical element contamination preventing device for an extreme ultraviolet light source apparatus according to claim 2, further comprising electrical field generating means for applying an electric field to the electrically charged scattered material for deflecting the scattered material, thereby preventing the scattered material from reaching the optical element, wherein the electric field generating means generates in the plasma generation region where the first plasma is generated by the $CO_2$ laser an electric field independently of an electric field generated by the plasma generating device, and the electric field generating means comprises a plurality of electrodes and a power source connected to the plurality of the electrodes.

4. The optical element contamination preventing device for an extreme ultraviolet light source apparatus according to claim 2, further comprising background gas supply means for supplying into the chamber a background gas for deflecting the scattered material, thereby preventing the scattered material from reaching the optical element.

5. The optical element contamination preventing device for an extreme ultraviolet light source apparatus according to claim 2, further comprising heating means for heating the scattered material for evaporating the scattered material.

6. The optical element contamination preventing device for an extreme ultraviolet light source apparatus according to claim 1, wherein the optical element comprises a multilayer film mirror for detecting an intensity of EUV light.

7. The optical element contamination preventing device for an extreme ultraviolet light source apparatus according to claim 1, wherein the equipment having the optical element comprises an EUV light detector for detecting an intensity of EUV light.

8. The optical element contamination preventing device for an extreme ultraviolet light source apparatus according to claim 1, further comprising A grid electrode disposed between the collector mirror and the plasma, and A direct current power supply for generating an electrical potential difference between the mirror and the grid electrode.

9. The optical element contamination preventing device for an extreme ultraviolet light source apparatus according to claim 1, further comprising a grid electrode disposed in the vicinity of a surface of the optical element or a surface of the equipment having the optical element, and a direct current power supply for generating an electrical potential difference between the grid electrode and the surface of the optical element or the surface of the equipment having the optical element.

10. The optical element contamination preventing device for an extreme ultraviolet light source apparatus according to claim 9, wherein the optical element comprises a multilayer film mirror for detecting an intensity of EUV light.

11. The optical element contamination preventing device for an extreme ultraviolet light source apparatus according to claim 9, wherein the equipment having the optical element comprises an EUV light detector for detecting an intensity of EUV light.

12. An extreme ultraviolet light source apparatus comprising the optical element contamination preventing device of claim 1, for generating an extreme ultraviolet light by excitation of a target supplied to a predetermined position within a chamber by a laser beam, the apparatus comprising;

a target supply device for supplying the target into the chamber; and a target position adjustment mechanism for adjusting the position of the supplied target to the predetermined position.

13. An extreme ultraviolet light source apparatus according to claim 12, further comprising:

a target recovery device produced at a position opposing the target supply device and sandwiching the predetermined position; and a position adjustment mechanism for adjusting the position of the target recovery device.

* * * * *